US009588463B2

(12) United States Patent
Suzuki et al.

(10) Patent No.: US 9,588,463 B2
(45) Date of Patent: Mar. 7, 2017

(54) DEVELOPER CONTAINER, IMAGE FORMING UNIT, AND IMAGE FORMING APPARATUS

(71) Applicant: Oki Data Corporation, Tokyo (JP)

(72) Inventors: Masayuki Suzuki, Tokyo (JP); Hisatoshi Saito, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/973,305

(22) Filed: Dec. 17, 2015

(65) Prior Publication Data

US 2016/0282760 A1 Sep. 29, 2016

(30) Foreign Application Priority Data

Mar. 26, 2015 (JP) ..... 2015-064034

(51) Int. Cl.
*G03G 15/08* (2006.01)

(52) U.S. Cl.
CPC ..... *G03G 15/0889* (2013.01); *G03G 15/0834* (2013.01); *G03G 15/0865* (2013.01); *G03G 15/0891* (2013.01); *G03G 2215/085* (2013.01); *G03G 2221/1657* (2013.01)

(58) Field of Classification Search
CPC ..... G03G 15/0889; G03G 15/0891; G03G 15/0834; G03G 15/0865
USPC ..... 399/254–257
See application file for complete search history.

(56) References Cited

U.S. PATENT DOCUMENTS

2007/0031168 A1 2/2007 Koyama
2009/0257781 A1 10/2009 Fuji

FOREIGN PATENT DOCUMENTS

JP 2005-292366 A 10/2005

*Primary Examiner* — Hoang Ngo
(74) *Attorney, Agent, or Firm* — Rabin & Berdo, P.C.

(57) ABSTRACT

A developer container includes: a housing having at least one storage chamber for storing developer; a first rotating member extending from a first end portion to a second end portion through at least one of the at least one storage chamber; a first gear connected to the first end portion; and a second gear connected to the second end portion, the first rotating member being configured to transmit driving force from the first gear to the second gear.

20 Claims, 26 Drawing Sheets

DEVELOPER CONTAINER, IMAGE FORMING UNIT, AND IMAGE FORMING APPARATUS

BACKGROUND OF THE INVENTION

1. Field of the Invention

The present invention relates to a developer container, an image forming unit, and an image forming apparatus.

2. Description of the Related Art

An image forming apparatus is known which forms a toner image on a photosensitive drum in an image forming unit and transfers the toner image onto a recording medium. Such an image forming apparatus may have an agitator for agitating toner in a toner storage portion. For example, Japanese Patent Application Publication No. 2005-292366 discloses an image forming unit including an agitating bar rotatably extending in a longitudinal direction of a toner storage portion.

SUMMARY OF THE INVENTION

An aspect of the present invention is intended to provide a developer container, an image forming unit, and an image forming apparatus capable of transmitting driving force.

According to an aspect of the present invention, there is provided a developer container including: a housing having at least one storage chamber for storing developer; a first rotating member extending from a first end portion to a second end portion through at least one of the at least one storage chamber; a first gear connected to the first end portion; and a second gear connected to the second end portion, the first rotating member being configured to transmit driving force from the first gear to the second gear.

According to another aspect of the present invention, there is provided an image forming unit including: the above developer container; a housing having a developing chamber to which the developer stored in one of the at least one storage chamber is supplied; a first driving force transmitting portion configured to transmit driving force to the first gear; a second driving force transmitting portion configured to receive the driving force from the first gear through the first rotating member and the second gear and transmit the driving force; and a second rotating member disposed in the developing chamber and configured to rotate by receiving the driving force transmitted from the second driving force transmitting portion.

According to another aspect of the present invention, there is provided an image forming apparatus including the above developer container.

According to another aspect of the present invention, there is provided an image forming apparatus including the above image forming unit.

BRIEF DESCRIPTION OF THE DRAWINGS

In the attached drawings:

FIGS. 20A and 20B are drawings for explaining an exemplary operation of the indicator in FIG. 15.

DETAILED DESCRIPTION OF THE INVENTION

Embodiments of the present invention will now be described with reference to the drawings.

First Embodiment

Exemplary Configuration (Exemplary Entire Configuration)

Figure 1:
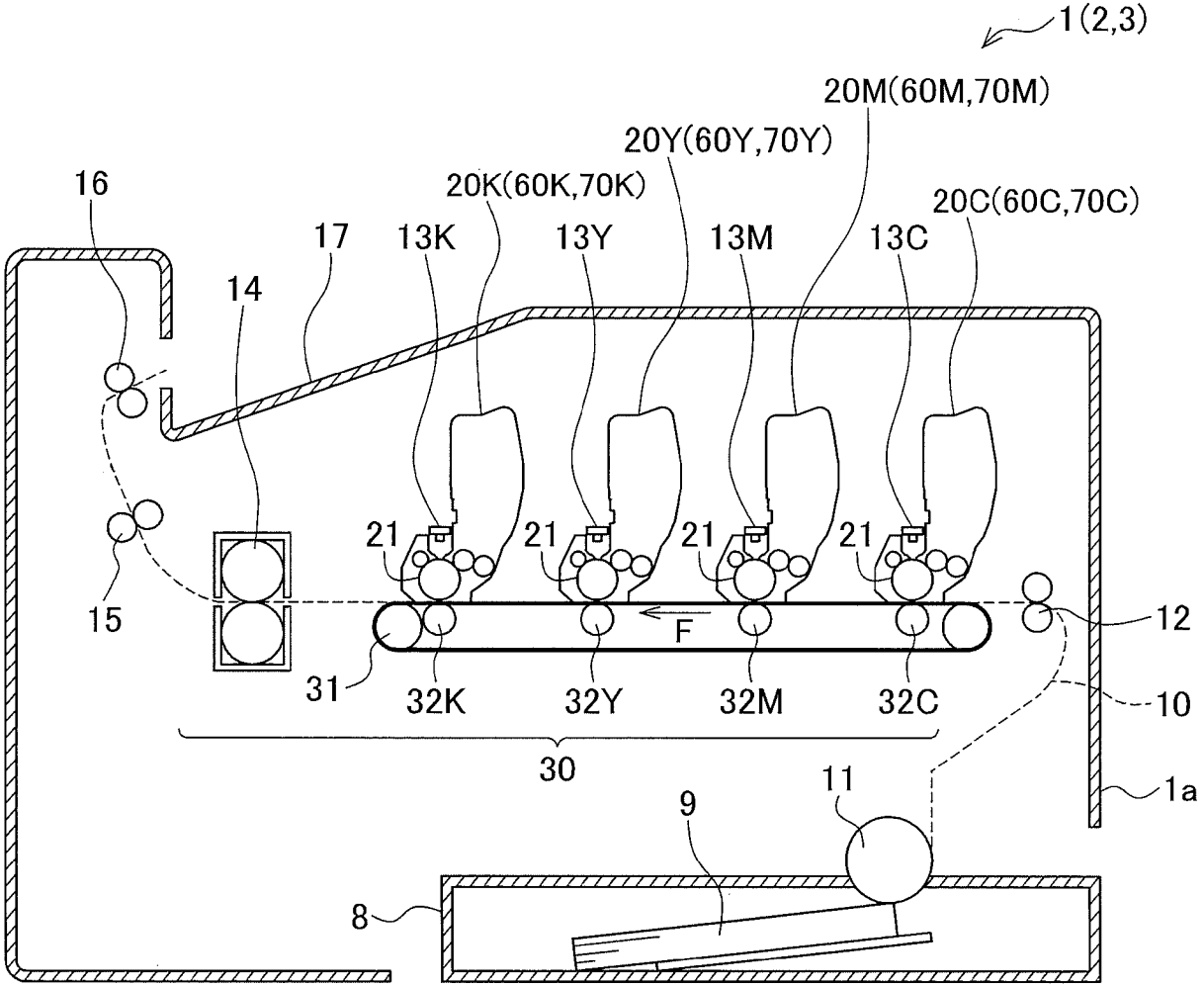
FIG. 1 is a view illustrating an exemplary configuration of an image forming apparatus in a first embodiment.

FIG. 1 illustrates an exemplary configuration of an image forming apparatus 1 including image forming units according to a first embodiment. The image forming apparatus 1 functions as a printer for forming an image on a recording medium, such as a sheet of plain paper, using an electrophotographic system.

The image forming apparatus 1 includes a paper feed roller 11, a pair of registration rollers 12, four image forming units 20K, 20Y, 20M, and 20C (also referred to collectively as the image forming units 20), four exposure heads 13K, 13Y, 13M, and 13C (also referred to collectively as the exposure heads 13), a transfer unit 30, a fixing unit 14, and pairs of discharge rollers 15 and 16. These members are arranged along a conveying path 10 on which recording media 9 are conveyed.

The paper feed roller 11 picks up the recording media 9 stored in a medium tray 8 one by one from the top thereof, and feeds the picked-up recording media 9 into the conveying path 10.

The pair of registration rollers 12 is composed of a pair of rollers with the conveying path 10 therebetween. The pair of registration rollers 12 corrects skew of the recording medium 9 fed from the paper feed roller 11 and conveys the recording medium 9 along the conveying path 10 to the image forming units 20.

The image forming units 20 form toner images. Specifically, the image forming unit 20K forms a black (K) toner image; the image forming unit 20Y forms a yellow (Y) toner image; the image forming unit 20M forms a magenta (M) toner image; the image forming unit 20C forms a cyan (C) toner image. In this example, the image forming units 20 are arranged in the order of the image forming units 20C, 20M, 20Y, and 20K in a conveying direction F of the recording medium 9. Each of the image forming units 20 is attachable to and detachable from a main body 1*a* of the image forming apparatus 1.

The exposure head 13K illuminates a photosensitive drum 21, described later, of the image forming unit 20K with light. The exposure head 13Y illuminates a photosensitive drum 21 of the image forming unit 20Y with light. The exposure head 13M illuminates a photosensitive drum 21 of the image forming unit 20M with light. The exposure head 13C illuminates a photosensitive drum 21 of the image forming unit 20C with light. Thus, these photosensitive drums 21 are exposed by the exposure heads 13K, 13Y, 13M, and 13C, so that electrostatic latent images are formed on surfaces of the photosensitive drums 21.

The transfer unit 30 transfers the toner images formed by the four image forming units 20K, 20Y, 20M, and 20C onto a surface of the recording medium 9 to which the toner images are to be transferred. The transfer unit 30 includes a transfer belt 31 and four transfer rollers 32K, 32Y, 32M, and 32C (also referred to collectively as the transfer rollers 32). The transfer belt 31 conveys the recording medium 9 along the conveying path 10. The transfer roller 32K is disposed facing the photosensitive drum 21 of the image forming unit 20K with the conveying path 10 and transfer belt 31 therebetween. The transfer roller 32Y is disposed facing the photosensitive drum 21 of the image forming unit 20Y with the conveying path 10 and transfer belt 31 therebetween. The transfer roller 32M is disposed facing the photosensitive drum 21 of the image forming unit 20M with the conveying path 10 and transfer belt 31 therebetween. The transfer roller 32C is disposed facing the photosensitive drum 21 of the image forming unit 20C with the conveying path 10 and transfer belt 31 therebetween. Each of the transfer rollers 32K, 32Y, 32M, and 32C is applied with a transfer voltage by a high-voltage power supply 54, as described later. Thereby, in the image forming apparatus 1, the toner images formed by the image forming units (or developing units) 20 are transferred onto the surface of the recording medium 9 to which the toner images are to be transferred.

The fixing unit 14 fixes to the recording medium 9 the toner images transferred on the recording medium 9 by applying heat and pressure to the recording medium 9.

The pair of discharge rollers 15 is composed of a pair of rollers with the conveying path 10 therebetween and conveys the recording medium 9 discharged from the fixing unit 14. The pair of discharge rollers 16 is composed of a pair of rollers with the conveying path 10 therebetween and discharges the recording medium 9 outside the image forming apparatus 1.

In this manner, the image forming apparatus 1 prints on the recording medium 9. The printed recording medium 9 is placed on a stacker cover 17.

(Image Forming Unit)

Figure 2:
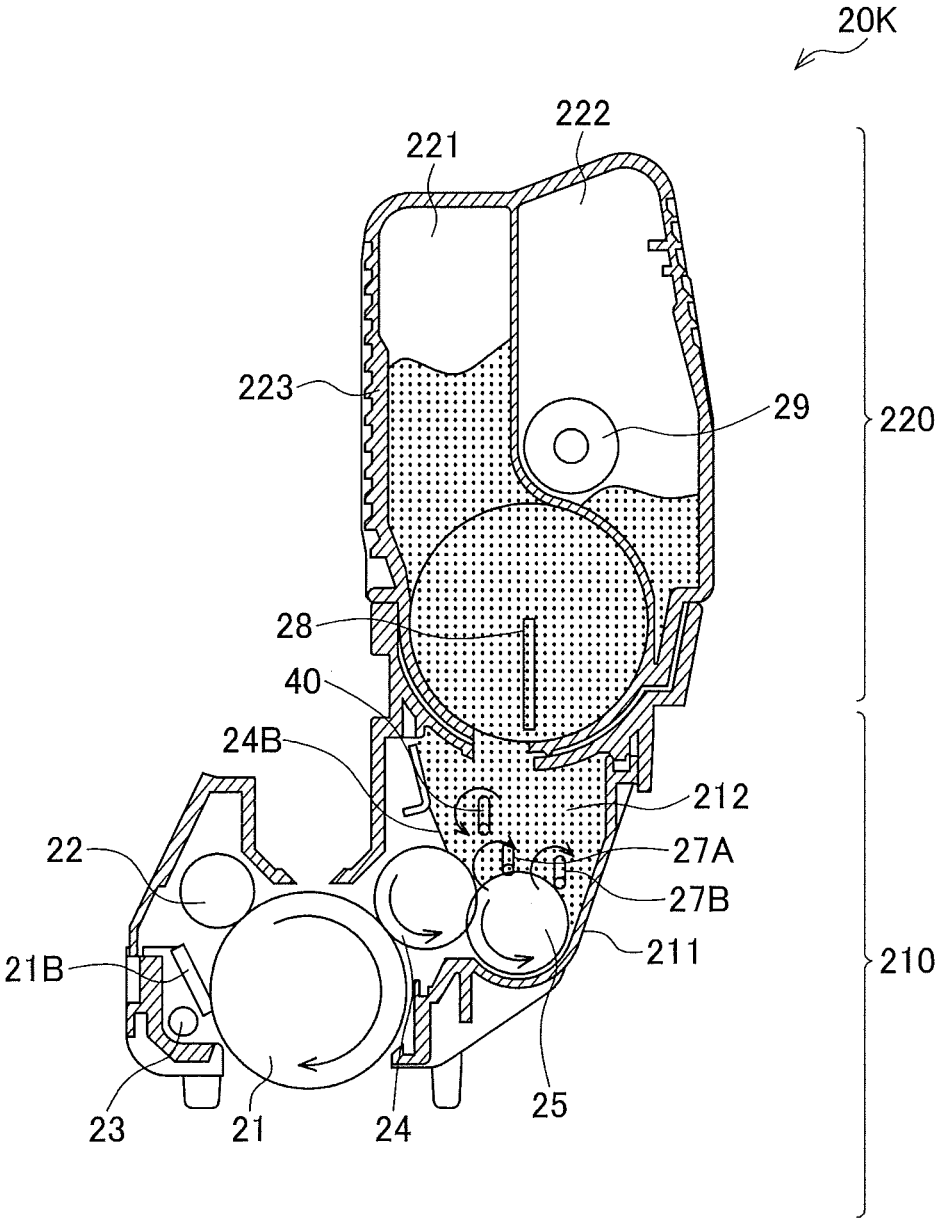
FIG. 2 is a sectional view illustrating an exemplary configuration of an image forming unit in the first embodiment.
Figure 3:
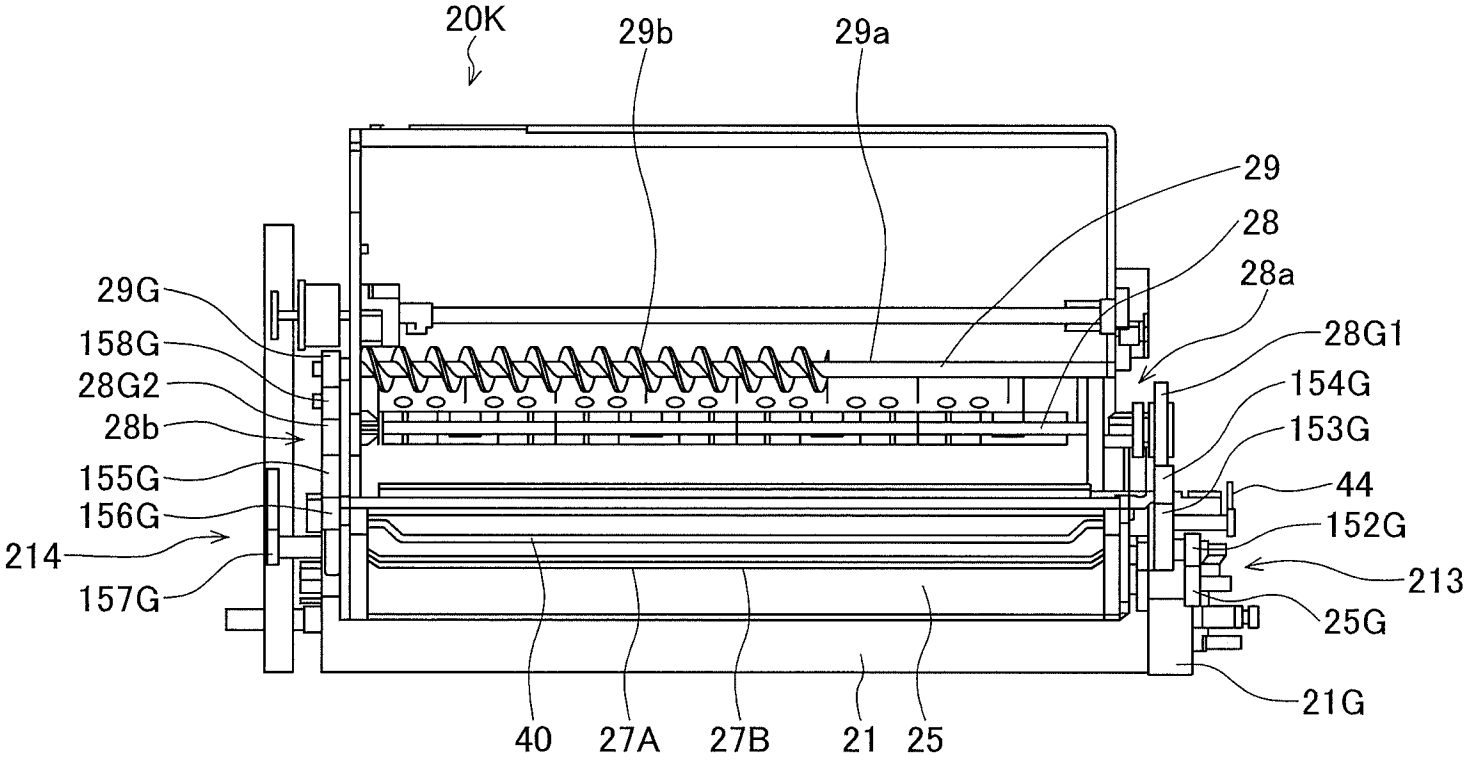
FIG. 3 is a view illustrating the exemplary configuration of the image forming unit in the first embodiment.

FIG. 2 illustrates a cross section of the image forming unit 20K. FIG. 3 illustrates an exemplary configuration of essential parts of the image forming unit 20K as viewed from the right in FIG. 2. The image forming unit 20K includes an image forming portion 210 and a toner storage portion (or toner cartridge) 220. The toner storage portion 220 is attachable to and detachable from the image forming unit 20K (or the image forming portion 210).

The image forming portion 210 includes the photosensitive drum 21, a charging roller 22, a cleaning blade 21B, a toner conveying member 23, a developing roller 24, a developing blade 24B, a supplying roller 25, a remaining amount detection bar 40, agitators 27A and 27B, and a housing 211 that houses these members of the image forming portion 210. The housing 211 has or defines a developing chamber 212. The image forming portion 210 further includes a first driving force transmitting portion 213 and a second driving force transmitting portion 214.

Figure 7:
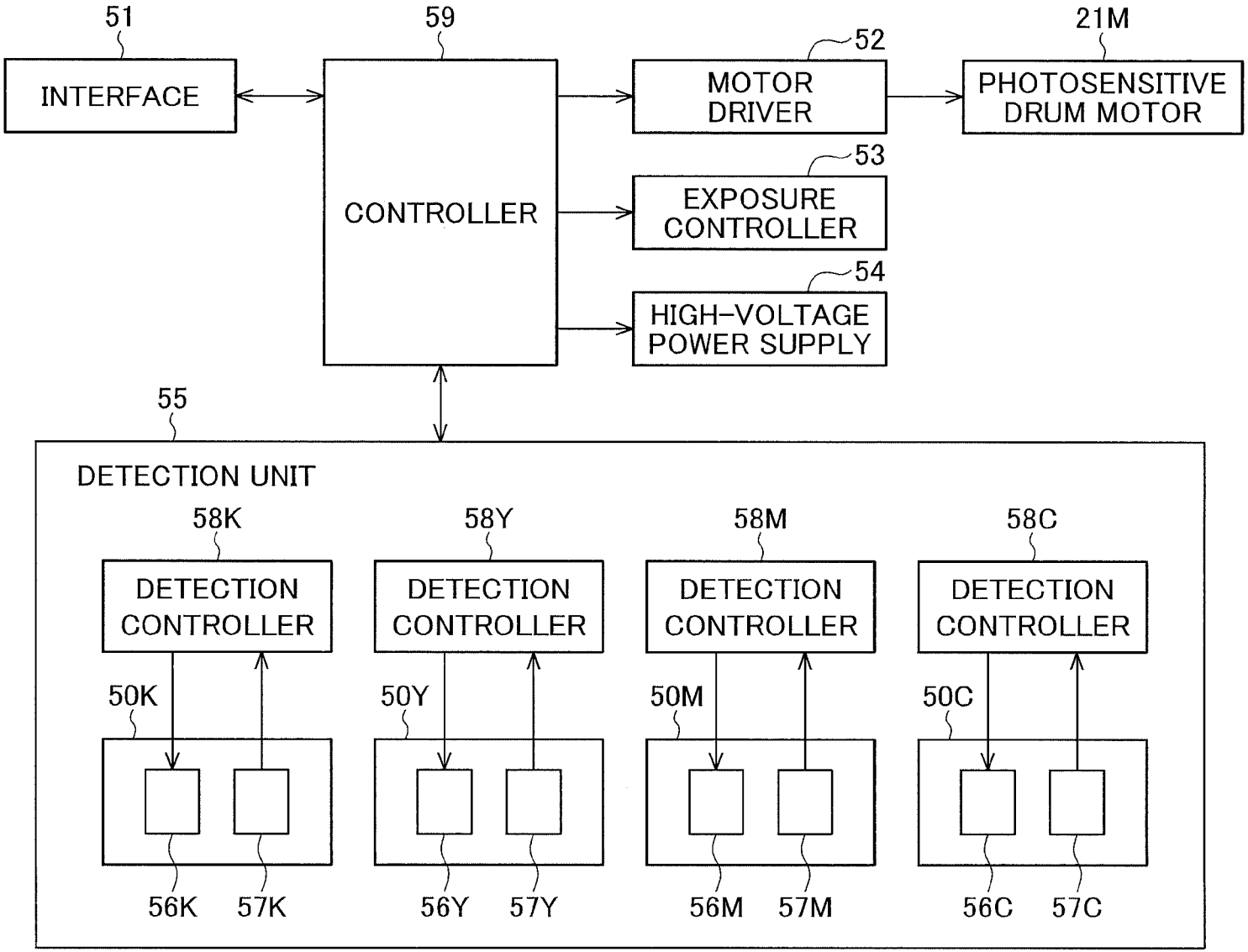
FIG. 7 is a block diagram illustrating an exemplary configuration of a control mechanism of the image forming apparatus in FIG. 1.

The photosensitive drum 21 carries an electrostatic latent image on its surface (or surface part), and is made using a photoreceptor. As illustrated in FIG. 3, one end of the photosensitive drum 21 is connected to a photosensitive drum gear 21G. The photosensitive drum gear 21G receives driving force (or power) from a photosensitive drum motor 21M (FIG. 7). The photosensitive drum 21 is rotated clockwise by the driving force received by the photosensitive drum gear 21G, as illustrated in FIG. 2. The photosensitive drum 21 is charged by the charging roller 22. The photosensitive drum 21 of the image forming unit 20K is exposed by the exposure head 13K, so that an electrostatic latent image is formed on the surface of the photosensitive drum 21.

The charging roller 22 charges the surface (or surface part) of the photosensitive drum 21. The charging roller 22 is disposed in contact with the surface (or peripheral surface) of the photosensitive drum 21. The charging roller 22 rotates with rotation of the photosensitive drum 21. The charging roller 22 is applied with a charging voltage by the high-voltage power supply 54, as described later.

The cleaning blade 21B scrapes off toner remaining on the surface (or surface part) of the photosensitive drum 21 to clean it.

The toner conveying member 23 conveys the toner (or waste toner) scraped off by the cleaning blade 21B to a waste toner chamber 222 (described later) of the toner storage portion 220.

The developing roller 24 carries toner on its surface. The developing roller 24 is disposed in contact with the surface (or peripheral surface) of the photosensitive drum 21. One end of the developing roller 24 is connected to a developing roller gear 24G (described later). The developing roller gear 24G receives driving force (or power), by which the developing roller 24 is rotated counterclockwise, as illustrated in FIG. 2. The developing roller 24 supplies toner to the photosensitive drum 21 to develop the electrostatic latent image, so that a toner image corresponding to the electrostatic latent image is formed on the photosensitive drum 21.

The developing roller 24 is applied with a developing voltage by the high-voltage power supply 54, as described later.

The developing blade 24B abuts against the surface of the developing roller 24 to form a layer (or toner layer) of toner on the surface of the developing roller 24 and regulate, control, or adjust the thickness of the toner layer. The developing blade 24B is applied with a supplying voltage by the high-voltage power supply 54, as described later.

The supplying roller 25 supplies the toner stored in the toner cartridge 220 to the developing roller 24. The supplying roller 25 is disposed in contact with the surface (or peripheral surface) of the developing roller 24. As illustrated in FIG. 3, one end of the supplying roller 25 is connected to a supplying roller gear 25G. The supplying roller gear 25G receives driving force (or power), by which the supplying roller 25 is rotated counterclockwise, as illustrated in FIG. 2. This causes friction between the surface of the supplying roller 25 and the surface of the developing roller 24, so that the toner is charged due to the friction. The supplying roller 25 is applied with the supplying voltage by the high-voltage power supply 54, as described later.

The remaining amount detection bar 40 is a rotating member disposed in the developing chamber 212 and configured to rotate by receiving driving force transmitted from the second driving force transmitting portion 214. The remaining amount detection bar 40 is a member for detecting the amount of toner remaining in the image forming unit 20K. The remaining amount detection bar 40 has a crank shape, as illustrated in FIG. 3. One end of the remaining amount detection bar 40 is connected to a remaining amount detection bar gear 40G (described later). The remaining amount detection bar gear 40G receives driving force (or power), by which the remaining amount detection bar 40 is rotated counterclockwise, as illustrated in FIG. 2. The remaining amount detection bar 40 is configured so that the remaining amount of toner is detected using variation in resistance against rotation of the remaining amount detection bar 40 depending on the remaining amount of toner.

The agitators 27A and 27B agitate the toner. The agitators 27A and 27B are disposed near the supplying roller 25. The agitators 27A and 27B each rotate clockwise, as illustrated in FIG. 2.

The developing roller 24, developing blade 24B, supplying roller 25, remaining amount detection bar 40, and agitators 27A and 27B are disposed in the developing chamber 212. The developing chamber 212 is supplied with toner from a toner chamber 221 (described later) of the toner storage portion 220.

The first driving force transmitting portion 213 is configured to transmit driving force to an agitating bar gear 28G1 (described later) of the toner storage portion 220. Specifically, the first driving force transmitting portion 213 is configured to receive driving force from the photosensitive drum motor (or driving source) 21M and transmit the driving force to the agitating bar gear 28G1. In this embodiment, the first driving force transmitting portion 213 is composed of the photosensitive drum gear 21G, the developing roller gear 24G, the supplying roller gear 25G, and idle gears 151G to 154G (described later).

The second driving force transmitting portion 214 is configured to receive the driving force from the agitating bar gear 28G1 through an agitating bar 28 (described later) and an agitating bar gear 28G2 (described later) of the toner storage portion 220 and transmit the driving force. In this embodiment, the second driving force transmitting portion 214 is composed of idle gears 155G to 157G (described later).

The toner storage portion 220 includes a housing 223, the agitating bar 28, and a conveying spiral 29. The housing 223 has or defines at least one storage chamber (in this embodiment, the toner chamber 221 and waste toner chamber 222) for storing developer. The toner chamber 221 and waste toner chamber 222 are provided in the housing 223 and separated by the housing 223.

The toner chamber 221 stores toner. Specifically, the toner chamber 221 of the image forming unit 20K stores black (K) toner.

The agitating bar 28 is a rotating member extending from a first end portion 28*a* to a second end portion 28*b* through at least one of the at least one storage chamber (in this embodiment, the toner chamber 221). The agitating bar 28 is a rotating body extending from the first end portion 28*a* to the second end portion 28*b* through one of the at least one storage chamber (in this embodiment, the toner chamber 221). The agitating bar 28 is an agitating member for agitating the toner in the toner chamber 221. The agitating bar 28 supplies the toner in the toner chamber 221 to the image forming portion 210. As illustrated in FIG. 3, the first end portion 28*a* of the agitating bar 28 is connected to the agitating bar gear 28G1 and the second end portion 28*b* is connected to the agitating bar gear 28G2. The agitating bar 28 is configured to transmit driving force (or power) from the agitating bar gear 28G1 to the agitating bar gear 28G2. Specifically, the agitating bar gear 28G1 receives driving force; the agitating bar 28 is rotated by the driving force received by the agitating bar gear 28G1 and transmits the driving force to the agitating bar gear 28G2.

The waste toner chamber 222 stores the waste toner conveyed by the toner conveying member 23. Specifically, the waste toner chamber 222 of the image forming unit 20K stores black (K) waste toner.

The conveying spiral 29 is a conveying member for conveying the waste toner in the waste toner chamber 222. As illustrated in FIG. 3, the conveying spiral 29 has a shaft 29*a* and a spiral blade 29*b* disposed around the shaft 29*a*. One end of the conveying spiral 29 is connected to a conveying spiral gear 29G. The conveying spiral gear 29G receives driving force, by which the conveying spiral 29 is rotated.

Figure 4A:
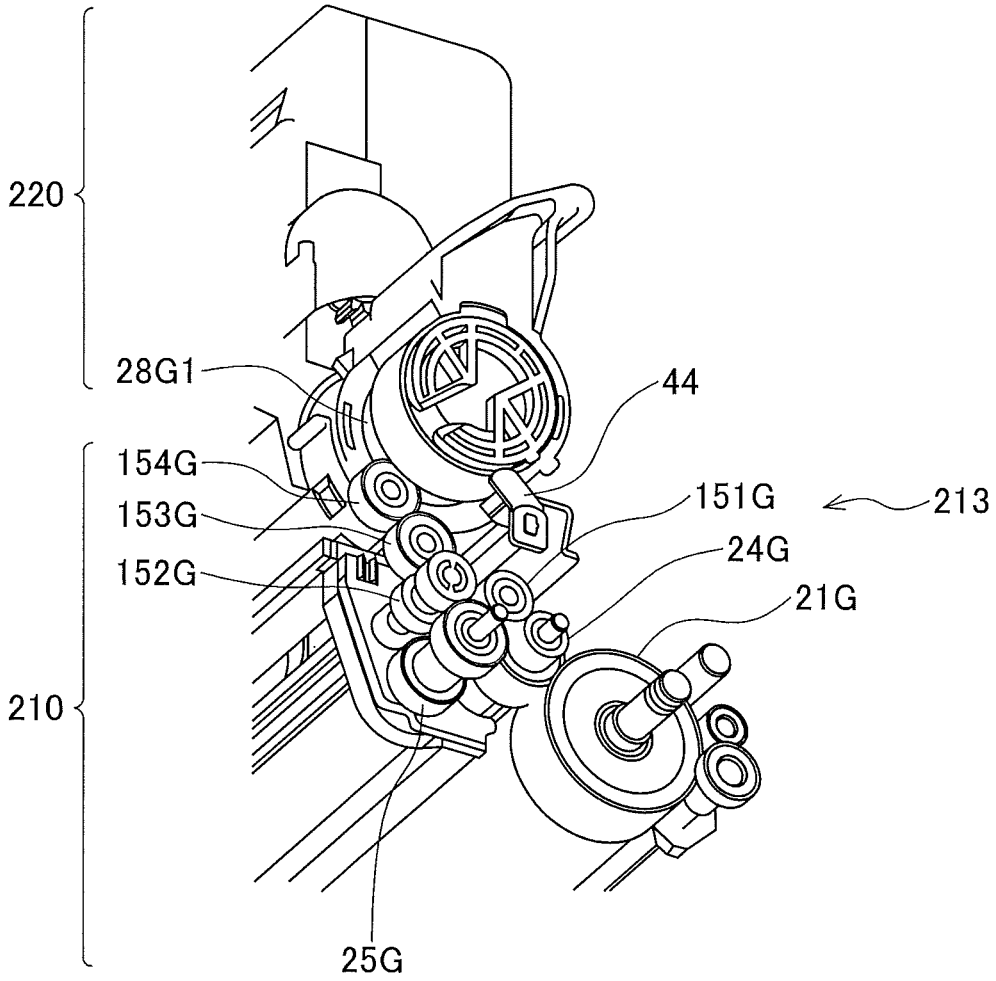
FIG. 4A is a perspective view illustrating an exemplary configuration of a drive mechanism of the image forming unit in FIG. 3.
Figure 4B:
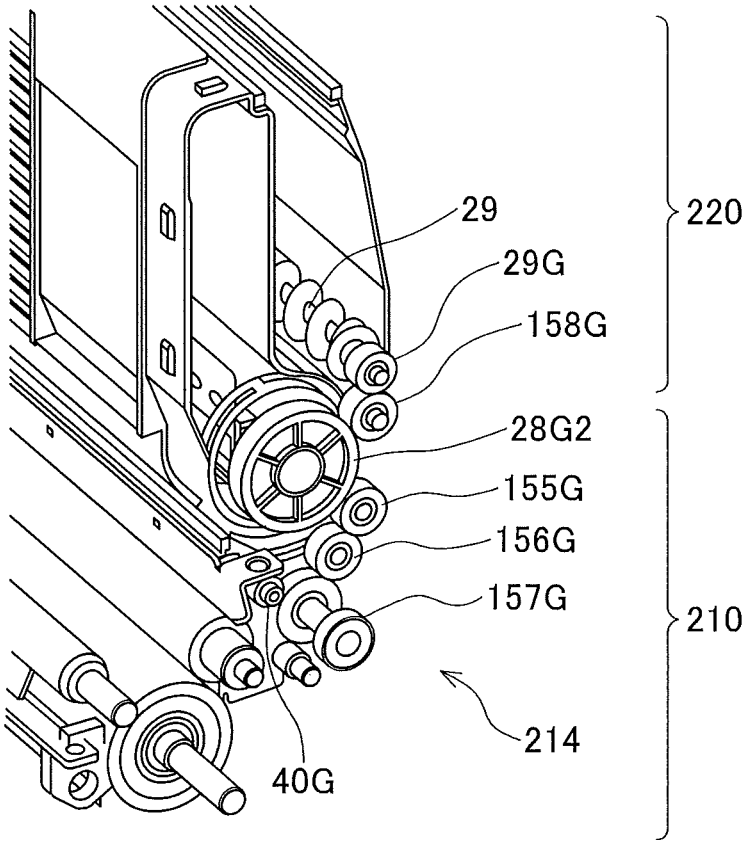
FIG. 4B is a perspective view illustrating an exemplary configuration of another drive mechanism of the image forming unit in FIG. 3.

FIGS. 4A and 4B illustrate exemplary configurations of drive mechanisms in the image forming unit 20K; FIG. 4A illustrates a drive mechanism disposed on the right side of the image forming unit 20K illustrated in FIG. 3; FIG. 4B illustrates a drive mechanism disposed on the left side of the image forming unit 20K illustrated in FIG. 3.

The image forming portion 210 includes the photosensitive drum gear 21G, developing roller gear 24G, supplying roller gear 25G, idle gears 151G to 157G, and remaining amount detection bar gear 40G. The toner storage portion 220 includes the agitating bar gears 28G1 and 28G2, the conveying spiral gear 29G, and an idle gear 158G.

As illustrated in FIG. 4A, the photosensitive drum gear 21G, developing roller gear 24G, idle gear 151G, supplying roller gear 25G, idle gear 152G, idle gear 153G, idle gear 154G, and agitating bar gear 28G1 are arranged on the right side of the image forming unit 20K illustrated in FIG. 3. As illustrated in FIG. 4B, the agitating bar gear 28G2, idle gear 155G, idle gear 156G, idle gear 157G, remaining amount detection bar gear 40G, idle gear 158G, and conveying spiral gear 29G are arranged on the left side of the image forming unit 20K illustrated in FIG. 3.

In the image forming unit 20K, first, the photosensitive drum gear 21G (FIG. 4A) receives driving force (or power) from the photosensitive drum motor 21M provided in the image forming apparatus 1. Then, the driving force is transmitted from the photosensitive drum gear 21G to the developing roller gear 24G, idle gear 151G, supplying roller gear 25G, idle gear 152G, idle gear 153G, idle gear 154G, and agitating bar gear 28G1 in this order.

The driving force received by the agitating bar gear 28G1 is transmitted through the agitating bar 28 to the agitating bar gear 28G2, as illustrated in FIG. 3. Then, the driving force received by the agitating bar gear 28G2 is transmitted from the agitating bar gear 28G2 to the idle gear 155G, idle gear 156G, idle gear 157G, and remaining amount detection bar gear 40G in this order, and is also transmitted from the agitating bar gear 28G2 to the idle gear 158G and conveying spiral gear 29G in this order, as illustrated in FIG. 4B.

In this manner, the image forming unit 20K is configured so that the remaining amount detection bar gear 40G receives driving force through the agitating bar 28 in the toner storage portion 220.

Figure 5:
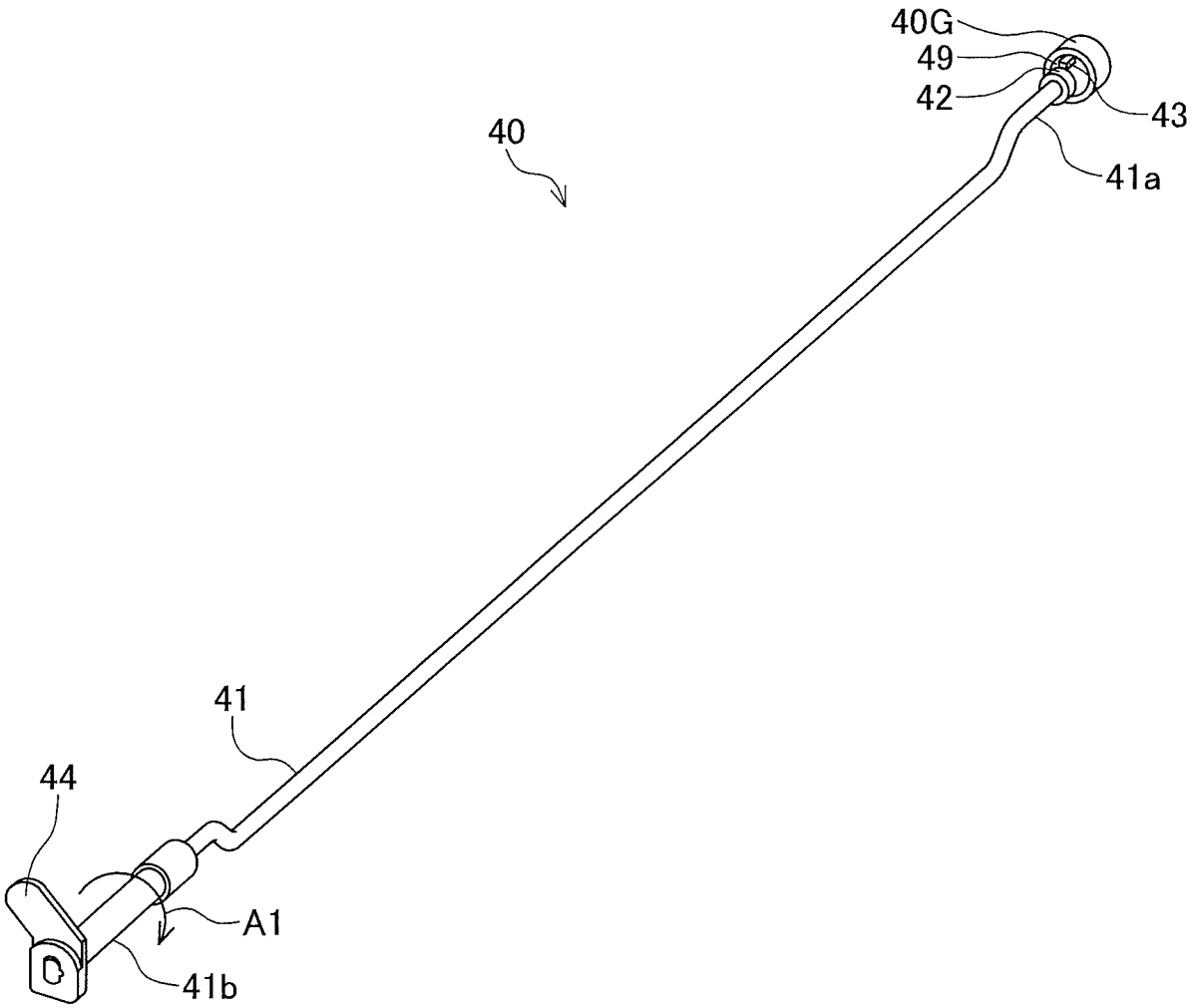
FIG. 5 is a perspective view illustrating an exemplary configuration of a remaining amount detection bar in FIG. 3.

FIG. 5 illustrates an exemplary configuration of the remaining amount detection bar 40. The remaining amount detection bar 40 includes a bar main body 41, a bearing 42, a projection 43, and a reflecting plate (or reflector) 44. The remaining amount detection bar 40 may include the remaining amount detection bar gear 40G.

The bar main body 41 is a rotating body extending from a first end portion 41*a* to a second end portion 41*b* through the developing chamber 212. The bar main body 41 is rotatable about a rotational axis of the remaining amount detection bar gear 40G in the direction indicated by arrow A1 in FIG. 5. The bar main body 41 has a crank shape. Thereby, when the bar main body 41 rotates, if there is toner around the bar main body 41, the bar main body 41 receives resistance from the toner.

The remaining amount detection bar gear 40G is connected to the first end portion 41*a* of the bar main body 41. The remaining amount detection bar gear 40G is configured to receive the driving force transmitted from the second driving force transmitting portion 214.

The bearing 42 is inserted between the bar main body 41 and the remaining amount detection bar gear 40G. The bearing 42 is fixed to the bar main body 41 so as to rotate integrally with the bar main body 41. The bearing 42 is mounted rotatably to the remaining amount detection bar gear 40G. The range of rotation of the bearing 42 relative to the remaining amount detection bar gear 40G is limited by the projection 43 and a projection 49, as described later. Thus, the bar main body 41 is rotatable relative to the remaining amount detection bar gear 40G within a predetermined angular range, as described later.

The projection 43 projects from the bearing 42 in a direction perpendicular to the rotational axis of the bar main body 41. Specifically, the projection 43 projects in a direction opposite to a direction (downward direction in FIG. 5) in which the bar main body 41 is bent. On the other hand, the remaining amount detection bar gear 40G has a projection 49 on its surface on the bearing 42 side. The projection 49 is configured to limit the range of rotation of the bearing 42 relative to the remaining amount detection bar gear 40G by abutting against the projection 43. When the remaining amount detection bar gear 40G rotates, the projection 49 of the remaining amount detection bar gear 40G pushes the projection 43 in a circumferential direction, thereby rotating the bar main body 41.

The reflecting plate 44 is connected to the second end portion 41*b* of the bar main body 41. The reflecting plate 44 is a member for reflecting light. The reflecting plate 44 is disposed at a position displaced from the rotational axis of the bar main body 41. Specifically, the reflecting plate 44 is disposed at a position displaced in a direction (upward direction in FIG. 5) opposite to the direction (downward direction in FIG. 5) in which the bar main body 41 is bent. That is, in a plane perpendicular to the rotational axis, as viewed in the direction of the rotational axis, the reflecting plate 44 is disposed at a position opposite the center of gravity of the bar main body 41. Also, the reflecting plate 44 is disposed so that it has a reflecting surface on a side opposite the bar main body 41.

Figure 6:
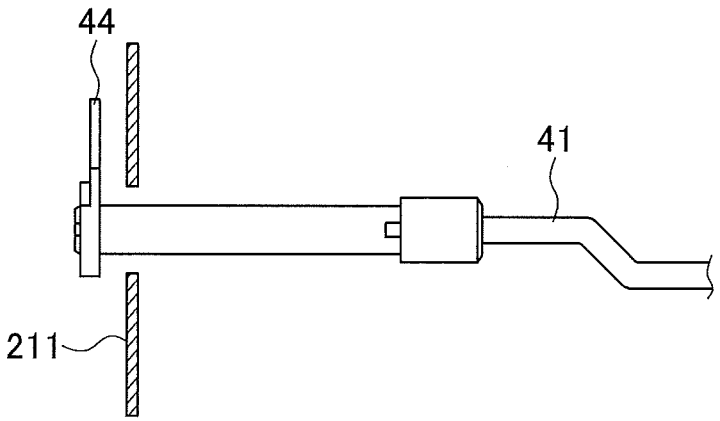
FIG. 6 is a view illustrating an exemplary configuration of a reflecting plate in FIG. 5.

FIG. 6 illustrates an exemplary configuration of the reflecting plate 44. The bar main body 41 is disposed to pass through the housing 211 of the image forming portion 210. Thus, the reflecting plate 44 is disposed outside the housing 211 so that it has the reflecting surface on a side opposite the housing 211.

The image forming units 20Y, 20M, and 20C are substantially the same as the image forming unit 20K except for the following points. The photosensitive drum 21 of the image forming unit 20Y is exposed by the exposure head 13Y; the photosensitive drum 21 of the image forming unit 20M is exposed by the exposure head 13M; the photosensitive drum 21 of the image forming unit 20C is exposed by the exposure head 13C. The toner chamber 221 of the image forming unit 20Y stores yellow (Y) toner; the toner chamber 221 of the image forming unit 20M stores magenta (M) toner; the toner chamber 221 of the image forming unit 20C stores cyan (C) toner. The waste toner chamber 222 of the image forming unit 20Y stores yellow (Y) waste toner; the waste toner chamber 222 of the image forming unit 20M stores magenta (M) waste toner; the waste toner chamber 222 of the image forming unit 20C stores cyan (C) waste toner.

<Control Mechanism of Image Forming Apparatus>

FIG. 7 illustrates an exemplary control mechanism of the image forming apparatus 1. The image forming apparatus 1 includes an interface 51, a motor driver (or motor controller) 52, an exposure controller 53, the high-voltage power supply 54, a detection unit 55, and a controller 59.

The interface 51 receives print data from a host computer (not illustrated), and sends and receives various control signals to and from the host computer, for example.

The motor driver 52 controls the operation of motors in the image forming apparatus 1, thereby causing the paper feed roller 11, image forming units 20, transfer unit 30, fixing unit 14, and pairs of discharge rollers 15 and 16 to operate.

The exposure controller 53 controls the exposure operation of each of the exposure heads 13.

The high-voltage power supply 54 applies the respective voltages to the charging rollers 22, developing rollers 24, developing blades 24B, and supplying rollers 25 of the image forming units 20, and the transfer rollers 32.

The detection unit 55 detects, for each of the image forming units 20, the remaining amount of toner and the presence or absence of the toner storage portion 220, by means of the remaining amount detection bar 40. Here, the detection of the presence or absence of the toner storage portion 220 includes not only detection of whether the toner storage portion 220 is mounted to the image forming unit 20 (or image forming portion 210) but also detection of whether the toner storage portion 220 is properly mounted to the image forming unit 20 (or image forming portion 210), for example. The detection unit 55 includes detectors 50K, 50Y, 50M, and 50C (also referred to collectively as the detectors 50) and detection controllers 58K, 58Y, 58M, and 58C (also referred to collectively as the detection controllers 58).

The detector 50K is configured to face the reflecting plate 44 of the image forming unit 20K and detect the position of the reflecting plate 44 of the image forming unit 20K. In the example of FIG. 7, the detector 50K includes a light emitting element 56K and a light receiving element 57K. The light emitting element 56K and light receiving element 57K are disposed facing the reflecting plate 44 of the image forming unit 20K. The light emitting element 56K emits light to the reflecting plate 44 of the remaining amount detection bar 40 of the image forming unit 20K. The light receiving element 57K receives light reflected by the reflecting plate 44 of the image forming unit 20K to output a signal DET corresponding to the intensity of the received light. The signal DET indicates the position of the reflecting plate 44 of the image forming unit 20K. In this example, the light emitting element 56K emits the light in accordance with instructions from the detection controller 58K, and the light receiving element 57K supplies the signal DET to the detection controller 58K.

The detectors 50Y, 50M, and 50C are substantially the same as the detector 50K. The detectors 50Y, 50M, and 50C are configured to face the reflecting plates 44 of the image forming units 20Y, 20M, and 20C and detect the positions of the reflecting plates 44 of the image forming units 20Y, 20M, and 20C, respectively. The detectors 50Y, 50M, and 50C include light emitting elements 56Y, 56M, and 56C and light receiving elements 57Y, 57M, and 57C, respectively.

The detection controller 58K is configured to detect the amount of toner in the image forming unit 20K (specifically, developing chamber 212) based on a result of the detection by the detector 50K. In this example, the detection controller 58K controls the light emitting operation of the light emitting element 56K in accordance with instructions from the controller 59 and detects the amount of toner remaining in the image forming unit 20K and the presence or absence of the toner storage portion 220 in the image forming unit 20K, based on the signal DET supplied from the light receiving element 57K.

The detection controllers 58Y, 58M, and 58C are substantially the same as the detection controller 58K. The detection controllers 58Y, 58M, and 58C are configured to detect the amounts of toner in the image forming units 20Y, 20M, and 20C based on detection results of the detectors 50Y, 50M, and 50C, respectively.

Figure 8A:
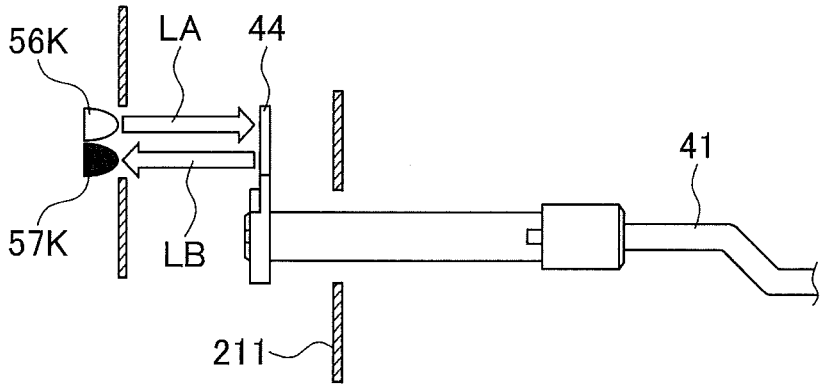
FIGS. 8A and 8B are drawings for explaining an exemplary operation of a detection unit in FIG. 7.
Figure 8B:
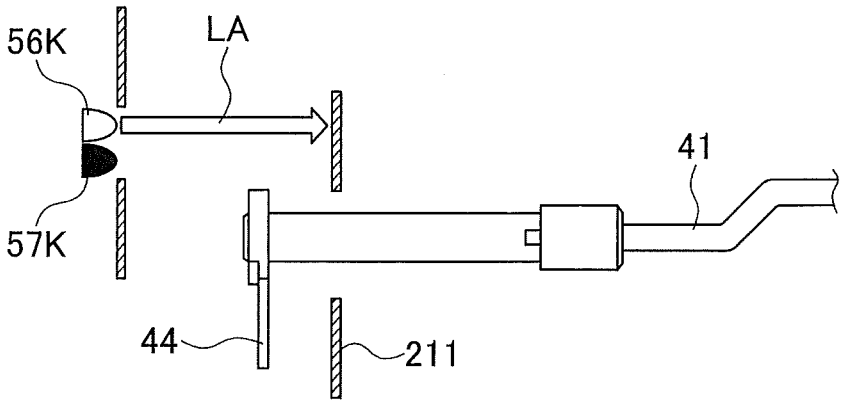

FIGS. 8A and 8B illustrate the detection operation of the detection unit 55. As illustrated in FIGS. 8A and 8B, the light emitting element 56K and light receiving element 57K are disposed above the rotational axis of the bar main body 41 (or remaining amount detection bar 40) in the image forming unit 20K.

The remaining amount detection bar 40 is rotated about the rotational axis by the driving force (or power) received by the remaining amount detection bar gear 40G. For example, as illustrated in FIG. 8A, when the reflecting plate 44 of the remaining amount detection bar 40 is located above the rotational axis, the reflecting plate 44 reflects light LA emitted from the light emitting element 56K and the light receiving element 57K receives the reflected light LB. For example, as illustrated in FIG. 8B, when the reflecting plate 44 is located below the rotational axis, the reflecting plate 44 does not reflect the light LA emitted from the light emitting element 56K and thus the light receiving element 57K receives no reflected light. Thus, the intensity of light received by the light receiving element 57K varies with the rotation of the remaining amount detection bar 40. The light receiving element 57K supplies the signal DET corresponding to the intensity of the received light to the detection controller 58K. The detection controller 58K detects the remaining amount of toner in the image forming unit 20K and the presence or absence of the toner storage portion 220 in the image forming unit 20K, based on the signal DET supplied from the light receiving element 57K.

The light emitting elements 56Y, 56M, and 56C and light receiving elements 57Y, 57M, and 57C operate in the same manner as the light emitting element 56K and light receiving element 57K. The detection controllers 58Y, 58M, and 58C operate in the same manner as the detection controller 58K. The detection controllers 58Y, 58M, and 58C detect the remaining amounts of toner and the presence or absence of the toner storage portions 220 in the image forming units 20Y, 20M, and 20C, based on the signals DET supplied from the light receiving elements 57Y, 57M, and 57C, respectively.

The controller 59 controls the entire operation of the image forming apparatus 1 by controlling the above blocks (e.g., interface 51, motor driver 52, exposure controller 53, high-voltage power supply 54, and detection unit 55). The controller 59 may include, for example, a microprocessor, a read only memory (ROM), a random access memory (RAM), an input/output port, and a timer.

The toner storage portion 220 serves as a developer container. The agitating bar 28 serves as a first rotating member. The agitating bar gear 28G1 serves as a first gear. The agitating bar gear 28G2 serves as a second gear. The remaining amount detection bar 40 serves as a second rotating member. The remaining amount detection bar gear 40G serves as a third gear. The reflecting plate 44 serves as a plate portion. Each of the detection controllers 58K, 58Y, 58M, and 58C serves as a developer detector.

<Operation>

Next, the operation of the image forming apparatus 1 of this embodiment will be described.

(Entire Operation)

First, the entire operation of the image forming apparatus 1 will be described with reference to FIGS. 1 to 7. When the controller 59 (FIG. 7) receives print data from the host computer through the interface 51, it controls the blocks of the image forming apparatus 1 to start printing. Specifically, the controller 59 first controls the motor driver 52 to cause the paper feed roller 11 and the pair of the registration rollers 12 (FIG. 1) to operate, so that a recording medium 9 is conveyed to the transfer unit 30. The controller 59 also controls the high-voltage power supply 54 to apply the voltages to the charging roller 22, developing roller 24, developing blade 24B, and supplying roller 25 (FIG. 2) of each of the image forming units 20, and each of the transfer rollers 32 (FIG. 1). The controller 59 then controls the exposure controller 53 to cause each of the exposure heads 13 (FIG. 1) to operate in accordance with the print data, so that an electrostatic latent image is formed on the surface of the photosensitive drum 21 in each of the image forming units 20.

Simultaneously, the controller 59 controls the motor driver 52 to cause the photosensitive drum motor 21M to operate. In each of the image forming units 20, the photosensitive drum gear 21G (FIG. 4A) receives driving force from the photosensitive drum motor 21M. The driving force is transmitted from the photosensitive drum gear 21G to the developing roller gear 24G, idle gear 151G, supplying roller gear 25G, idle gear 152G, idle gear 153G, idle gear 154G, and agitating bar gear 28G1 in this order. Thereby, the agitating bar 28 and agitators 27A and 27B (FIG. 2) rotate and agitate the toner. The supplying roller 25 rotates and supplies the toner to the developing roller 24. The developing roller 24 rotates, and the developing blade 24B forms a toner layer on the surface of the developing roller 24. The photosensitive drum 21 rotates, and a toner image corresponding to the electrostatic latent image is formed on the surface of the photosensitive drum 21. At this time, the cleaning blade 21B scrapes off toner (or waste toner) remaining on the surface of the photosensitive drum 21, and the toner conveying member 23 conveys the waste toner to the waste toner chamber 222 of the toner storage portion 220.

The agitating bar gear 28G2 (FIG. 3) receives the driving force from the agitating bar gear 28G1 through the agitating bar 28. The driving force is transmitted from the agitating bar gear 28G2 to the idle gear 158G and conveying spiral gear 29G in this order (FIG. 4B). Thereby, the conveying spiral 29 (FIG. 3) rotates and conveys the waste toner in the waste toner chamber 222.

The driving force received by the agitating bar gear 28G2 (FIG. 4B) from the agitating bar gear 28G1 through the agitating bar 28 is also transmitted to the idle gear 155G, idle gear 156G, idle gear 157G, and remaining amount detection bar gear 40G in this order. Thereby, the remaining amount detection bar 40 (FIG. 3) rotates. As such, the remaining amount detection bar 40 receives the driving force (or power) through the toner storage portion 220. The detection unit 55 detects the remaining amount of toner and the presence or absence of the toner storage portion 220, by using the remaining amount detection bar 40, for each of the image forming units 20.

(Detection Operation)

Next, an exemplary operation of the remaining amount detection bar 40 of the image forming unit 20K, detector 50K, and detection controller 58K will be described. Hereinafter, a case C1 where a small amount of toner remains in the developing chamber 212 of the image forming unit 20K, a case C2 where a large amount of toner remains in the developing chamber 212 of the image forming unit 20K, and cases C3 and C4 where the toner storage portion 220 of the image forming unit 20K is absent will be described.

(Case C1)

FIGS. 9A to 9E illustrate an exemplary operation of the remaining amount detection bar 40 in the case C1 where a small amount of toner 100 remains in the developing chamber 212. Each of FIGS. 9A to 9E illustrates on the left side the direction of the reflecting plate 44, and on the right side the direction of the projection 43.

Figure 9A:
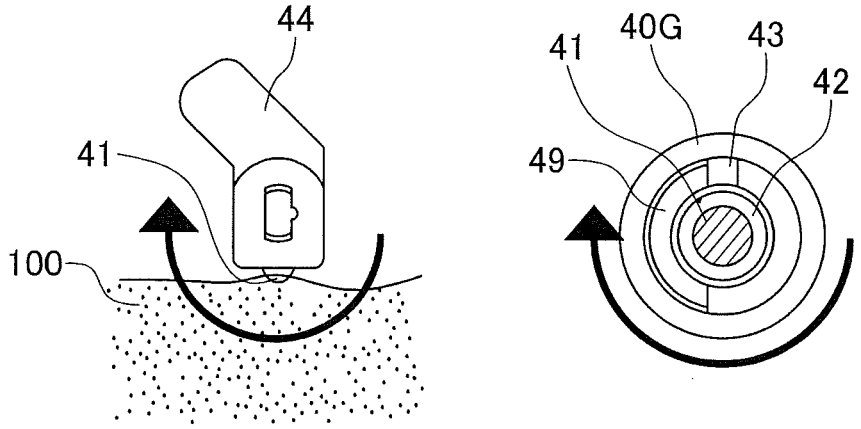
FIGS. 9A to 9E are drawings for explaining an exemplary operation of the remaining amount detection bar in FIG. 5.

In the state of FIG. 9A, the projection 43 and reflecting plate 44 are located above the rotational axis. The remaining amount detection bar gear 40G rotates clockwise, as indicated by arrow A2 in FIG. 9A. The period T of rotation of the remaining amount detection bar gear 40G is, for example, 5 seconds. The projection 49 of the remaining amount detection bar gear 40G pushes the projection 43 in a circumferential direction, as indicated by arrow A2 in FIG. 9A. Thereby, the remaining amount detection bar 40 rotates clockwise.

Figure 9B:
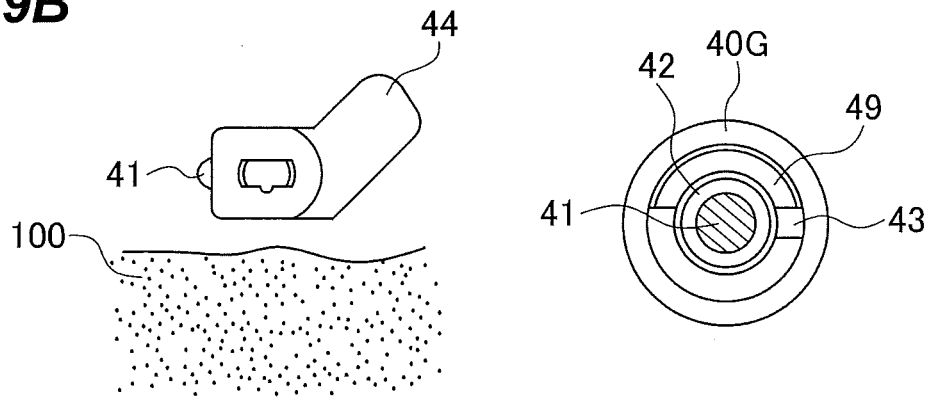

When a time approximately equal to one-quarter of the period T elapses, the state changes from the state of FIG. 9A to the state of FIG. 9B. In this state, the projection 43 and reflecting plate 44 are located to the right of the rotational axis. When a time approximately equal to one-quarter of the period T further elapses, the state changes from the state of FIG. 9B to the state of FIG. 9C. In this state, the projection 43 and reflecting plate 44 are located below the rotational axis.

Figure 9C:
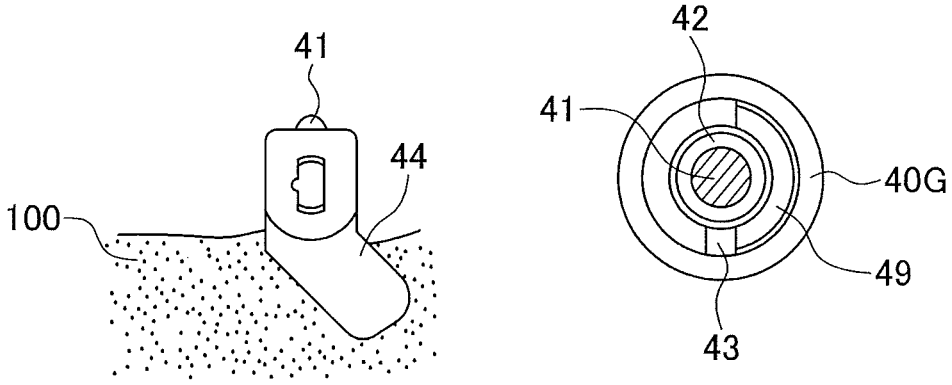
Figure 9D:
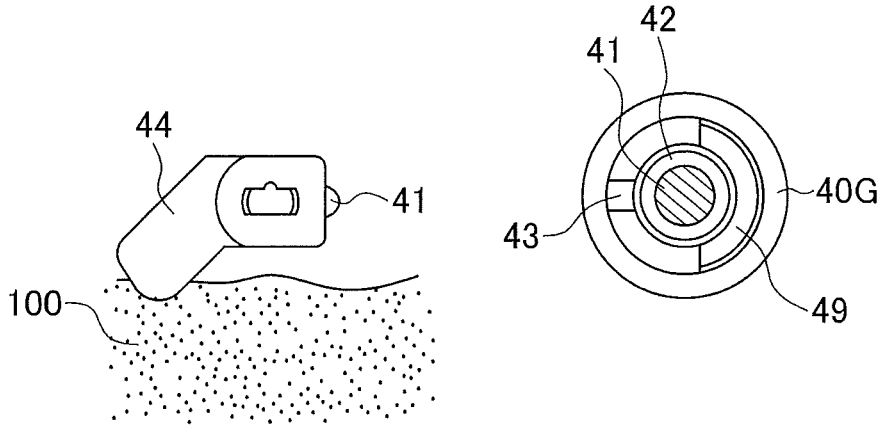
Figure 9E:
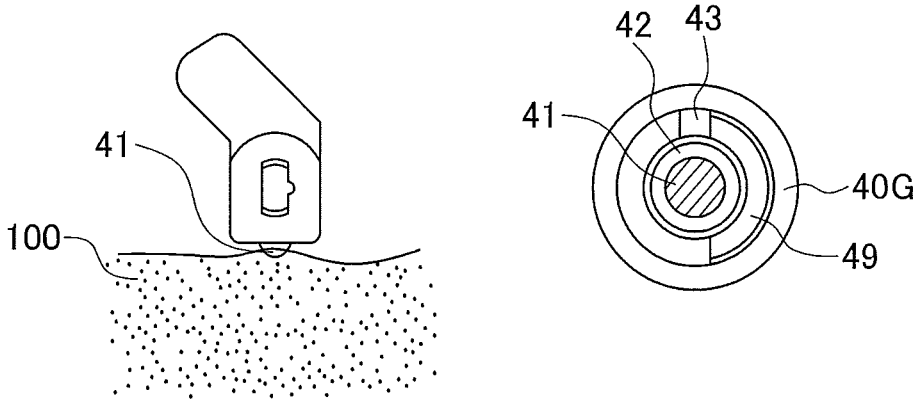

In the state of FIG. 9C, the center of gravity of the bar main body 41 is located above the rotational axis. In this example, the toner 100 is stored below the bar main body 41. Thus, the remaining amount detection bar 40 rotates continuously clockwise so that the center of gravity of the bar main body 41 is lowered, independently of driving force from the remaining amount detection bar gear 40G. Thereby, the state changes from the state of FIG. 9C to the state of FIG. 9D and then to the state of FIG. 9E. In the state of FIG. 9D, the projection 43 and reflecting plate 44 are located to the left of the rotational axis. In the state of FIG. 9E, the projection 43 and reflecting plate 44 are located above the rotational axis. At this time, the center of gravity of the bar main body 41 is at the lowermost position. In this manner, the remaining amount detection bar 40 rotates to the bottom dead center under its own weight.

Then, because of the clockwise rotation of the remaining amount detection bar gear 40G, the state changes again to the state of FIG. 9A. Thus, during the period during which the state changes from the state of FIG. 9E to the state of FIG. 9A, the projection 43 and reflecting plate 44 continue to be above the rotational axis. The length of the above period is approximately equal to one-half of the period T. The operation of the remaining amount detection bar 40 illustrated in FIGS. 9A to 9E is repeated. The light receiving element 57K detects the reflected light LB from the reflecting plate 44 of the remaining amount detection bar 40 operating in this manner and generates the signal DET.

Figure 10A:
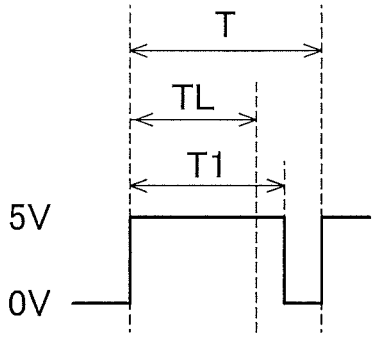
FIGS. 10A to 10D are waveform diagrams of signals generated by the detection unit in FIG. 7.

FIG. 10A illustrates an example of the signal DET in the case C1 where the remaining amount of toner 100 is small. In this example, when the light receiving element 57K receives the reflected light LB, the signal DET is 5 V; when the light receiving element 57K receives no reflected light LB, the signal DET is 0 V. As described above, in the case C1, during the period during which the state changes from the state of FIG. 9E to the state of FIG. 9A, the reflecting plate 44 continues to be above the rotational axis. Thus, in the case C1, the light receiving period T1 during which the light is received is long.

(Case C2)

FIGS. 11A to 11D illustrate an exemplary operation of the remaining amount detection bar 40 in the case C2 where a large amount of toner remains in the developing chamber 212.

Figure 11A:
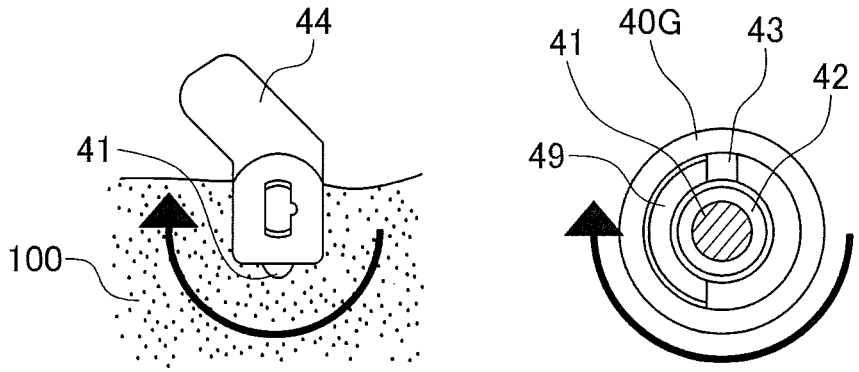
FIGS. 11A to 11D are drawings for explaining another exemplary operation of the remaining amount detection bar in FIG. 5.

In the state of FIG. 11A, the projection 43 and reflecting plate 44 are located above the rotational axis. The projection 49 of the remaining amount detection bar gear 40G pushes the projection 43 in a circumferential direction, as in the case C1. Thereby, the remaining amount detection bar 40 rotates clockwise.

Figure 11B:
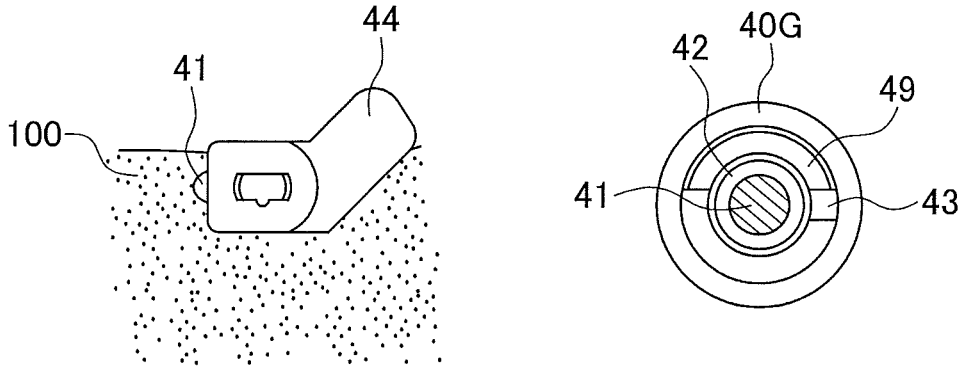

When a time approximately equal to one-quarter of the period T elapses, the state changes from the state of FIG. 11A to the state of FIG. 11B. In this state, the projection 43 and reflecting plate 44 are located to the right of the rotational axis. When a time approximately equal to one-quarter of the period T further elapses, the state changes from the state of FIG. 11B to the state of FIG. 11C. In this state, the projection 43 and reflecting plate 44 are located below the rotational axis. The above operation is the same as in the case C1.

Figure 11C:
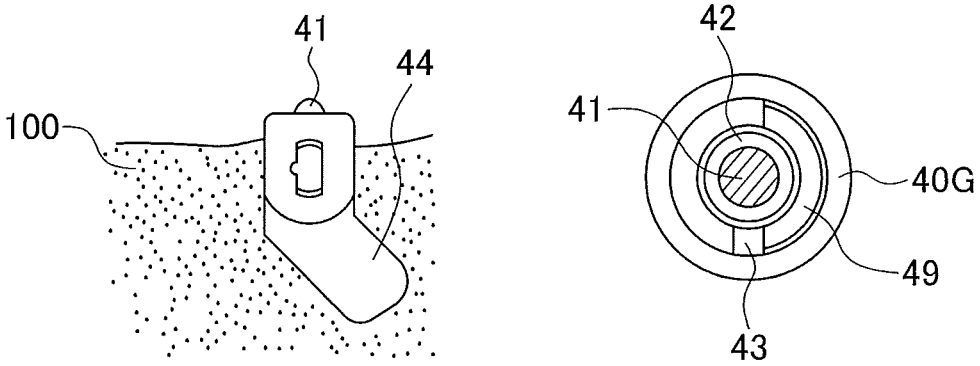

In the state of FIG. 11C, the center of gravity of the bar main body 41 is located above the rotational axis. However, in the case C2, unlike the case C1, since the remaining amount of toner 100 is large, the toner resists rotation of the remaining amount detection bar 40. Thus, the remaining amount detection bar 40 rotates due to pushing of the projection 43 by the projection 49, without rotating to the bottom dead center under its own weight as in the case C1.

Figure 11D:
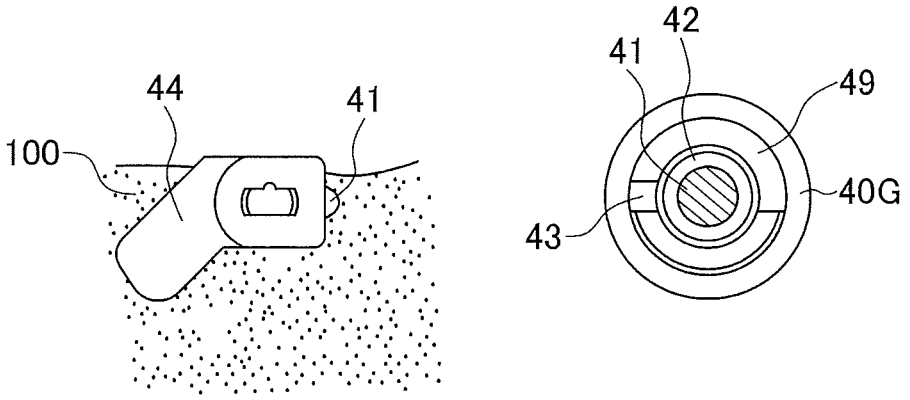

When a time approximately equal to one-quarter of the period T further elapses, the state changes from the state of FIG. 11C to the state of FIG. 11D. In this state, the projection 43 and reflecting plate 44 are located to the left of the rotational axis. Then, the state returns to the state of FIG. 11A. The operation of the remaining amount detection bar 40 illustrated in FIGS. 11A to 11D is repeated.

Figure 10B:
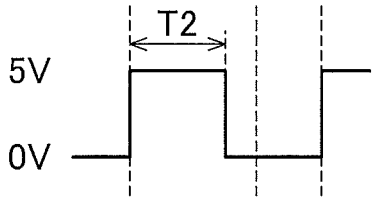

FIG. 10B illustrates an example of the signal DET in the case C2 where the remaining amount of toner is large. As described above, in the case C2, the remaining amount detection bar 40 rotates consistently due to pushing of the projection 43 by the projection 49. Thus, the light receiving period T2 in this case C2 is shorter than the light receiving period T1 in the case C1.

The detection controller 58K detects whether the remaining amount of toner is small (case C1) or large (case C2), based on the signal DET as illustrated in FIG. 10A or 10B. For example, if the state in which the light receiving period is greater than a predetermined threshold period TL (e.g., the state of FIG. 10A) continues over, for example, five periods (5T), the detection controller 58K determines that the remaining amount of toner is small. Then, the detection controller 58K notifies the controller 59 of the detection result, and the controller 59 notifies a user that the remaining amount of toner is small. On the other hand, if the light receiving period is less than the predetermined threshold period TL (e.g., the state of FIG. 10B), the detection controller 58K determines that the remaining amount of toner is large. In this case, the detection controller 58K does not notify the controller 59 of the detection result.

<Cases C3 and C4>

Next, the cases C3 and C4 where the toner storage portion 220 is absent will be described. As illustrated in FIG. 3, the agitating bar gear 28G2 receives driving force from the agitating bar gear 28G1 through the agitating bar 28. As illustrated in FIG. 4B, the driving force is transmitted from the agitating bar gear 28G2 to the remaining amount detection bar gear 40G through the idle gears 155G to 157G. Thus, the remaining amount detection bar 40 receives the driving force through the toner storage portion 220. Therefore, if the toner storage portion 220 is absent, the driving force is not transmitted to the remaining amount detection bar 40 and thus the remaining amount detection bar 40 does not rotate.

Figure 10C:
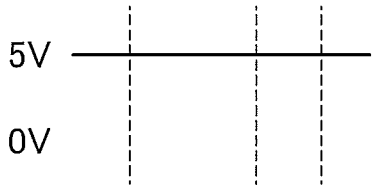
Figure 10D:
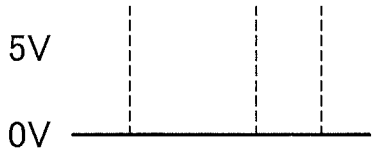

FIGS. 10C and 10D illustrate examples of the signals DET in the cases C3 and C4 where the toner storage portion 220 is absent, respectively. As described above, since the remaining amount detection bar 40 does not rotate, the reflecting plate 44 stays in the same position. Thus, for example, the light receiving element 57K constantly detects the reflected light LB from the reflecting plate 44 (FIG. 10C) or detects no reflected light LB (FIG. 10D).

The detection controller 58K detects the absence of the toner storage portion 220 (case C3 or C4) based on the signal DET illustrated in FIG. 10C or 10D. For example, if the state in which the reflected light LB is constantly received (the state of FIG. 10C) or the state in which no reflected light LB is received (the state of FIG. 10D) continues over, for example, two periods (2T), the detection controller 58K determines that the toner storage portion 220 is absent. Then, the detection controller 58K notifies the controller 59 of the detection result. The controller 59 notifies a user of the absence of the toner storage portion 220 (a mounting error) and controls the blocks in the image forming apparatus 1 to stop print operation.

In this manner, in the image forming apparatus 1, the remaining amount detection bar 40 receives driving force through the toner storage portion 220 in the image forming unit 20K. This allows the configuration of the image forming unit 20K to be simplified. Specifically, for example, if the remaining amount detection bar 40 were configured to receive driving force without intervention of the toner storage portion 220, the remaining amount of toner could be detected, but the presence or absence of the toner storage portion 220 could not be detected. In this case, if a special mechanism for detecting the presence or absence of the toner storage portion 220 were introduced, the configuration might be complicated. On the other hand, in the image forming apparatus 1, since the remaining amount detection bar 40 receives driving force through the toner storage portion 220, the presence or absence of the toner storage portion 220 can be detected by using the mechanism for detecting the remaining amount of toner. This allows the configuration of the image forming unit 20K to be simplified. As a result, for example, it is possible to downsize the image forming unit 20K and reduce the cost.

The operations of the remaining amount detection bars 40 of the image forming units 20Y, 20M, and 20C, detectors 50Y, 50M, and 50C, and detection controllers 58Y, 58M, and 58C are substantially the same as those of the remaining amount detection bar 40 of the image forming unit 20K, detector 50K, and detection controller 58K.

Modification

In the above embodiment, in the image forming unit 20K, the remaining amount detection bar 40 is disposed in the image forming portion 210, but this is not mandatory. For example, the remaining amount detection bar 40 may be disposed in the toner chamber 221 of the toner storage portion 220. In this configuration, if the toner storage portion 220 is absent, the remaining amount detection bar 40 is also absent and thus a state in which the light receiving element 57K of the detection unit 55 detects no reflected light LB is maintained, so that the signal DET is constant as illustrated in FIG. 10D. The same applies to the image forming units 20Y, 20M, and 20C.

Advantages

As above, in this embodiment, the remaining amount detection bars receive driving force through the toner storage portions. This makes it possible to simplify the configurations of the image forming units. As a result, for example, it is possible to downsize the image forming units and reduce the cost.

This embodiment discloses an image forming apparatus including: a developer container (the toner storage portion 220) including a storage chamber (the toner chamber 221) for storing a developer (the toner) and a transmitting unit (the agitating bar 28 and agitating bar gears 28G1 and 28G2) for transmitting driving force; a body (the main body 1*a* and image forming portion 210) to which the developer container is detachably mounted; a rotating member (the remaining amount detection bar 40) disposed in one of the developer container and the body and configured to rotate by receiving the driving force transmitted by the transmitting unit; and a detection unit (the detection unit 55) disposed in the body, the detection unit being configured to detect rotation of the rotating member and determine whether the developer container is mounted to the body, based on a result of the detection. With this configuration, it is possible to detect whether the developer container is mounted to the body. In one aspect, the body includes a developing chamber (the developing chamber 212) to which the developer stored in the storage chamber is supplied, and an image forming member (the developing roller 24) for forming an image using the developer stored in the developing chamber; the rotating member is disposed in the developing chamber; and the detection unit is configured to further determine the amount of the developer in the developing chamber based on a result of the detection. With this configuration, it is possible to detect whether the developer container is mounted to the body and the amount of the developer in the developing chamber, by means of the common rotating member. In another aspect, the rotating member is disposed in the storage chamber; and the detection unit is configured to further determine the amount of the developer in the storage chamber based on a result of the detection. With this configuration, it is possible to detect whether the developer container is mounted to the body and the amount of the developer in the storage chamber, by means of the common rotating member.

Second Embodiment

Next, an image forming apparatus 2 including image forming units 60K, 60Y, 60M, and 60C (also referred to collectively as the image forming units 60) according to a second embodiment will be described. The configurations of the image forming units 60 of this embodiment are different from those of the image forming units 20 of the above first embodiment. Otherwise, the configuration of the image forming apparatus 2 is substantially the same as that of the image forming apparatus 1. Parts that are substantially the same as those of the first embodiment will be given the same reference characters, and descriptions thereof will be omitted as appropriate. The image forming units 60 are substantially the same, so only the image forming unit 60K will be described.

Figure 12:
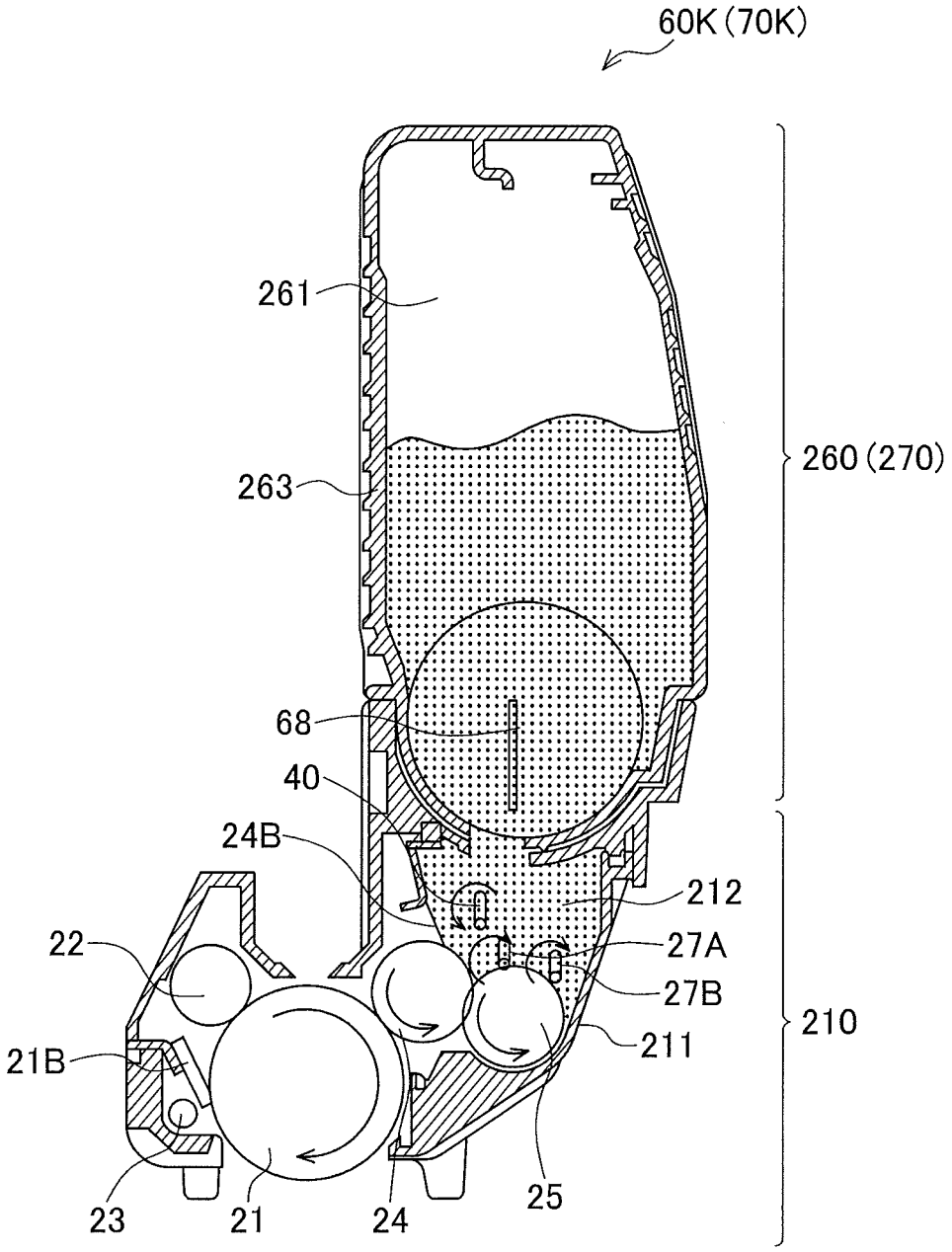
FIG. 12 is a sectional view illustrating an exemplary configuration of an image forming unit in a second embodiment.
Figure 13:
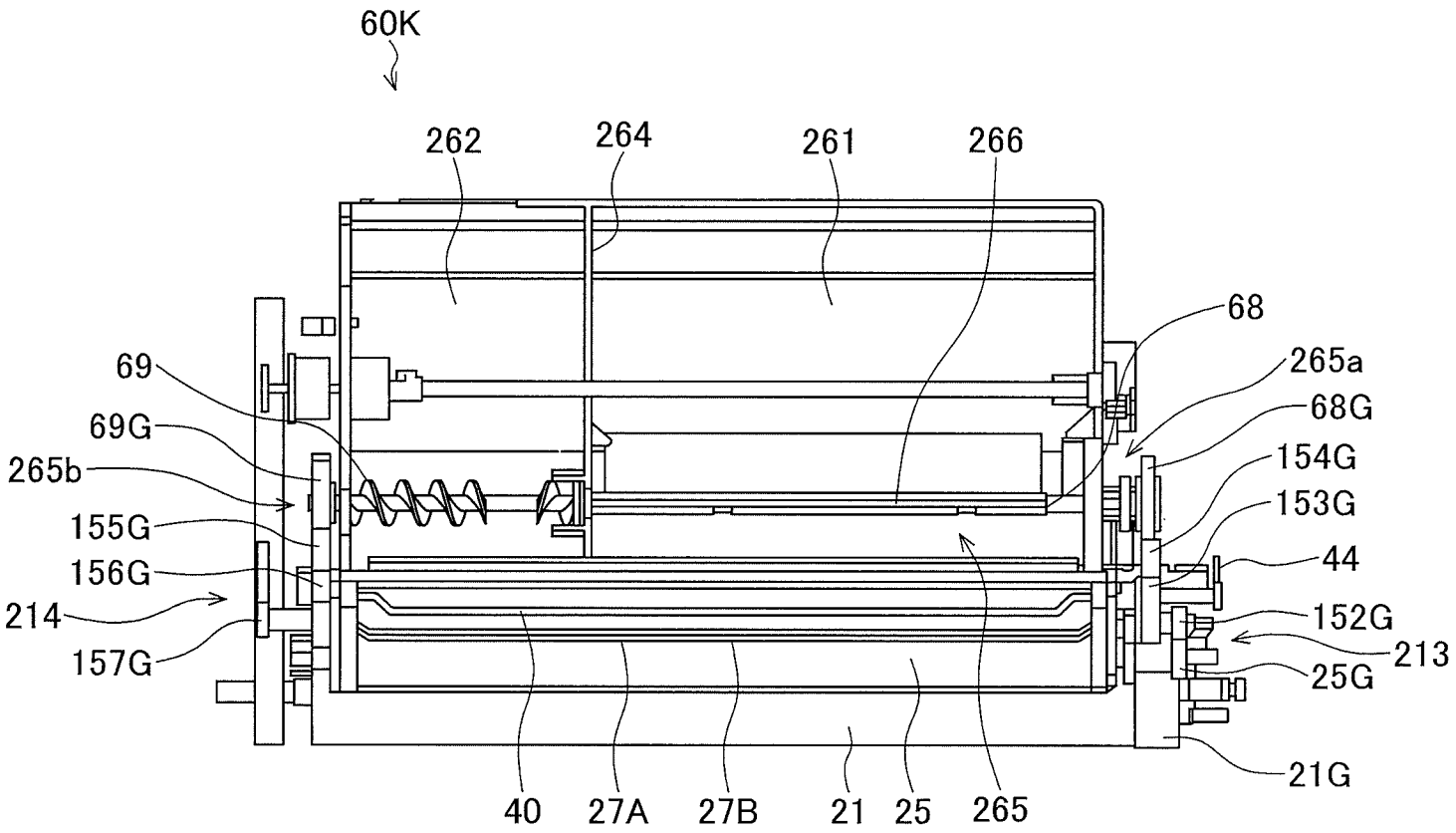
FIG. 13 is a view illustrating the exemplary configuration of the image forming unit in the second embodiment.

FIG. 12 illustrates a cross section of the image forming unit 60K. FIG. 13 illustrates an exemplary configuration of essential parts of the image forming unit 60K as viewed from the right in FIG. 12. The image forming unit 60K includes the image forming portion 210 and a toner storage portion 260.

The toner storage portion 260 includes a housing 263, an agitating bar 68, and a conveying spiral 69. The housing 263 has or defines at least one storage chamber for storing developer. In this embodiment, the housing 263 has a toner chamber 261 for storing toner as a first developer and a waste toner chamber 262 for storing waste toner as a second developer. The toner chamber 261 and waste toner chamber 262 are provided in the housing 263 and separated by an inner wall 264 of the housing 263.

In the above first embodiment, the toner chamber 221 and waste toner chamber 222 are arranged in a short side direction (the horizontal direction in FIG. 2 or the direction perpendicular to the drawing sheet in FIG. 3) perpendicular to a rotational axis of the agitating bar 28. On the other hand, in this embodiment, the toner chamber 261 and waste toner chamber 262 are arranged in a longitudinal direction (the horizontal direction in FIG. 13) of the toner storage portion 260 parallel to a rotational axis of the agitating bar 68.

The agitating bar 68 and conveying spiral 69 constitute a rotating member 265. The rotating member 265 extends from a first end portion 265*a* to a second end portion 265*b* through at least one of the at least one storage chamber (in this embodiment, the toner chamber 261 and waste toner chamber 262). The first end portion 265*a* is connected to an agitating bar gear 68G. The second end portion 265*b* is connected to a conveying spiral gear 69G. The rotating member 265 is configured to transmit driving force from the agitating bar gear 68G to the conveying spiral gear 69G.

The agitating bar 68 is a rotating body disposed in the toner chamber 261. The agitating bar 68 is an agitating member for agitating the toner stored in the toner chamber 261. The agitating bar 68 supplies the toner in the toner chamber 261 to the image forming portion 210. As illustrated in FIG. 13, one end portion of the agitating bar 68 is connected to the agitating bar gear 68G, and the other end portion of the agitating bar 68 is connected to the conveying spiral 69. The agitating bar 68 shares a common shaft 266 with the conveying spiral 69. The shaft 266 is disposed to pass through the inner wall 264 between the toner chamber 261 and the waste toner chamber 262. The agitating bar gear 68G receives driving force, by which the agitating bar 68 is rotated.

The conveying spiral 69 is a rotating body disposed in the waste toner chamber 262. The conveying spiral 69 is a conveying member for conveying the waste toner stored in the waste toner chamber 262. One end portion of the conveying spiral 69 is connected to the agitating bar 68 and the other end portion of the conveying spiral 69 is connected to the conveying spiral gear 69G. The conveying spiral 69 shares the shaft 266 with the agitating bar 68. The conveying spiral 69 is rotated by the driving force received by the agitating bar gear 68G and transmits the driving force to the conveying spiral gear 69G.

Figure 14A:
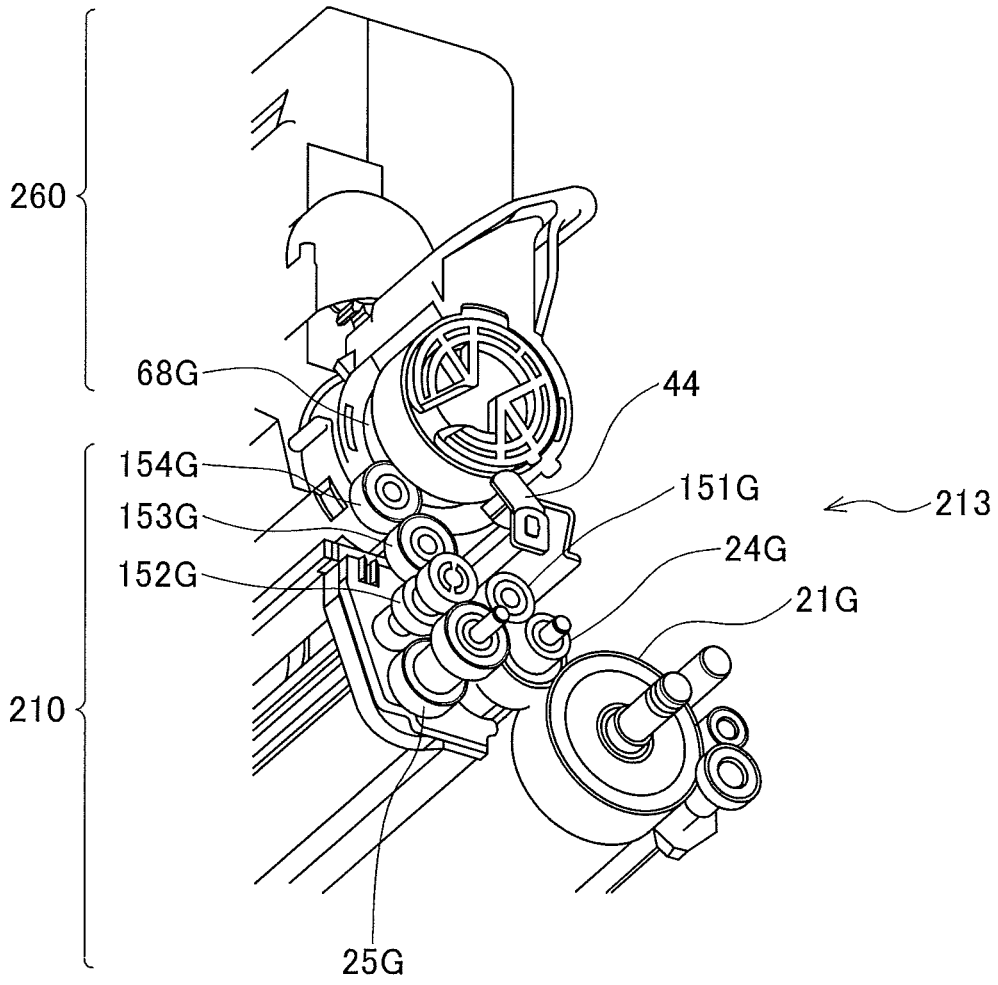
FIG. 14A is a perspective view illustrating an exemplary configuration of a drive mechanism of the image forming unit in FIG. 13.
Figure 14B:
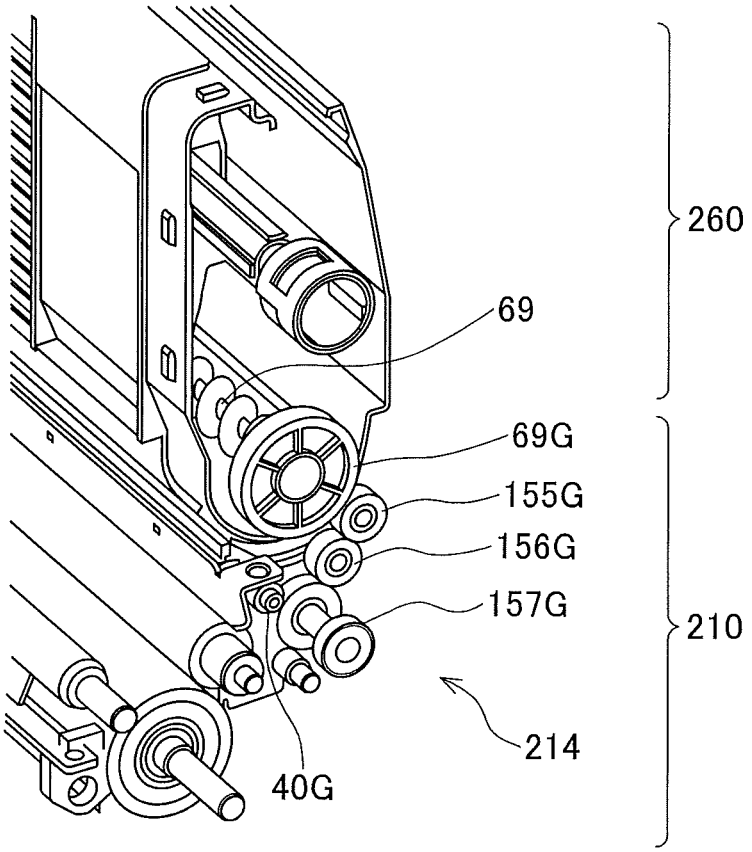
FIG. 14B is a perspective view illustrating an exemplary configuration of another drive mechanism of the image forming unit in FIG. 13.

FIGS. 14A and 14B illustrate exemplary configurations of drive mechanisms in the image forming unit 60K; FIG. 14A illustrates a drive mechanism disposed on the right side of the image forming unit 60K illustrated in FIG. 13; FIG. 14B illustrates a drive mechanism disposed on the left side of the image forming unit 60K illustrated in FIG. 13.

The toner storage portion 260 includes the agitating bar gear 68G and conveying spiral gear 69G. The agitating bar gear 68G is disposed on the right side of the image forming unit 60K illustrated in FIG. 13. The conveying spiral gear 69G is disposed on the left side of the image forming unit 60K illustrated in FIG. 13.

In the image forming unit 60K, first, the photosensitive drum gear 21G (FIG. 14A) receives driving force (or power) from the photosensitive drum motor 21M provided in the image forming apparatus 2. Then, the driving force is transmitted from the photosensitive drum gear 21G to the developing roller gear 24G, idle gear 151G, supplying roller gear 25G, idle gear 152G, idle gear 153G, idle gear 154G, and agitating bar gear 68G in this order.

The driving force received by the agitating bar gear 68G is transmitted through the agitating bar 68 and conveying spiral 69 to the conveying spiral gear 69G, as illustrated in FIG. 13. Then, the driving force received by the conveying spiral gear 69G is transmitted from the conveying spiral gear 69G to the idle gear 155G, idle gear 156G, idle gear 157G, and remaining amount detection bar gear 40G in this order, as illustrated in FIG. 14B.

In this manner, the image forming unit 60K is configured so that the remaining amount detection bar 40 receives driving force through the agitating bar 68 and conveying spiral 69 in the toner storage portion 260.

The toner storage portion 260 serves as a developer container. The toner chamber 261 serves as a first storage chamber. The waste toner chamber 262 serves as a second storage chamber. The agitating bar gear 68G serves as a first gear. The conveying spiral gear 69G serves as a second gear. The rotating member 265 serves as a first rotating member. The agitating bar 68 serves as a first rotating body. The conveying spiral 69 serves as a second rotating body.

As above, in this embodiment, the remaining amount detection bar receives driving force through the toner storage portion. Thus, as in the first embodiment, it is possible to simplify the configuration of the image forming unit. As a result, for example, it is possible to downsize the image forming unit and reduce the cost.

Modification

In the above embodiment, the remaining amount detection bar 40 is disposed in the image forming portion 210 of the image forming unit 60K, but this is not mandatory. For example, like the above modification of the first embodiment, the remaining amount detection bar 40 may be disposed in the toner chamber 261 of the toner storage portion 260.

Third Embodiment

Next, an image forming apparatus 3 including image forming units 70K, 70Y, 70M, and 70C (also referred to collectively as the image forming units 70) according to a third embodiment will be described. The configurations of the image forming units 70 of this embodiment are different from those of the image forming units 60 of the above second embodiment. Otherwise, the configuration of the image forming apparatus 3 is substantially the same as that of the image forming apparatus 2 of the second embodiment. Parts that are substantially the same as those of the second embodiment will be given the same reference characters, and descriptions thereof will be omitted as appropriate. The image forming units 70 are substantially the same, so only the image forming unit 70K will be described.

As illustrated in FIG. 12, the image forming unit 70K includes the image forming portion 210 and a toner storage portion 270.

Figure 15:
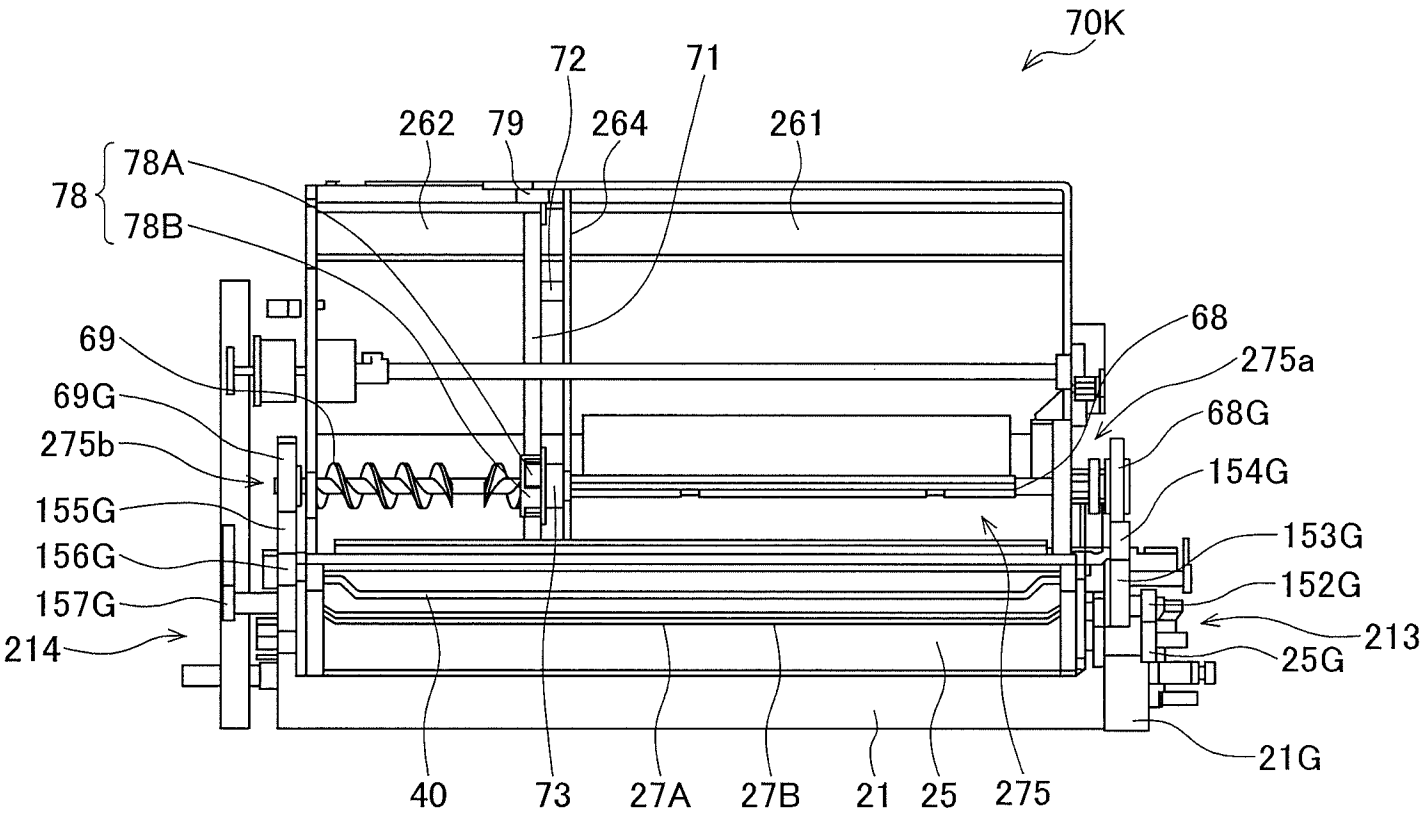
FIG. 15 is a view illustrating an exemplary configuration of an image forming unit in a third embodiment.

FIG. 15 illustrates an exemplary configuration of essential parts of the image forming unit 70K as viewed from the right in FIG. 12. The toner storage portion 270 includes a movable wall 71, springs 72 and 73, a clutch 78, and an indicator 79, in addition to the housing 263, agitating bar 68, and conveying spiral 69.

While in the above second embodiment, the agitating bar 68 shares the shaft 266 with the conveying spiral 69 (FIG. 13), the clutch 78 is provided between the agitating bar 68 and the conveying spiral 69 in this embodiment.

The agitating bar 68, clutch 78, and conveying spiral 69 constitute a rotating member 275. The rotating member 275 extends from a first end portion 275*a* to a second end portion 275*b* through at least one of the at least one storage chamber (in this embodiment, the toner chamber 261 and waste toner chamber 262). The first end portion 275*a* is connected to the agitating bar gear 68G. The second end portion 275*b* is connected to the conveying spiral gear 69G. The rotating member 275 is configured to transmit driving force from the agitating bar gear 68G to the conveying spiral gear 69G.

The movable wall 71 is configured to move according to the amount of waste toner in the waste toner chamber 262. The movable wall 71 is disposed near the inner wall 264, which is between the waste toner chamber 262 and the toner chamber 261, in the waste toner chamber 262, and is connected to the inner wall 264 through the springs 72 and 73.

The spring 72 is inserted between the movable wall 71 and the inner wall 264, and supports an upper part of the movable wall 71. The spring 73 is inserted between a first member 78A (described later) of the clutch 78 and the inner wall 264, and supports a lower part of the movable wall 71.

The clutch 78 is disposed between the agitating bar 68 and the conveying spiral 69 The clutch 78 is configured to transmit driving force between the agitating bar 68 and the conveying spiral 69. The clutch 78 is configured to be capable of interrupting the transmission of the driving force. Thus, the clutch 78 also serves as an interrupting member for interrupting the transmission of the driving force. The clutch 78 is configured to interrupt the transmission of the driving force when the amount of the waste toner stored in the waste toner chamber 262 reaches a predetermined amount. The clutch 78 includes the first member 78A and a second member 78B. The first member 78A has multiple claws capable of engaging with the second member 78B. The first member 78A is connected to a shaft of the agitating bar 68, and is configured so that the distance between the first member 78A and the agitating bar 68 can be changed by the spring 73. Also, the first member 78A is in contact with the movable wall 71, and moves according to movement of the movable wall 71. The second member 78B has multiple claws capable of engaging with the first member 78A (specifically, the claws of the first member 78A). Also, the second member 78B is connected to the conveying spiral 69.

With this configuration, the clutch 78 transmits driving force from the agitating bar 68 to the conveying spiral 69 by engagement of the claws of the first member 78A with the claws of the second member 78B. Also, the clutch 78 is configured to transmit the driving force when the amount of waste tonner in the waste toner chamber 262 is small, and interrupt the transmission of the driving force when the movable wall 71 has moved to a predetermined position due to increase of the amount of waste toner in the waste toner chamber 262.

The indicator 79 indicates the amount of waste toner in the waste toner chamber 262. The indicator 79 is connected to the movable wall 71.

Figure 16:
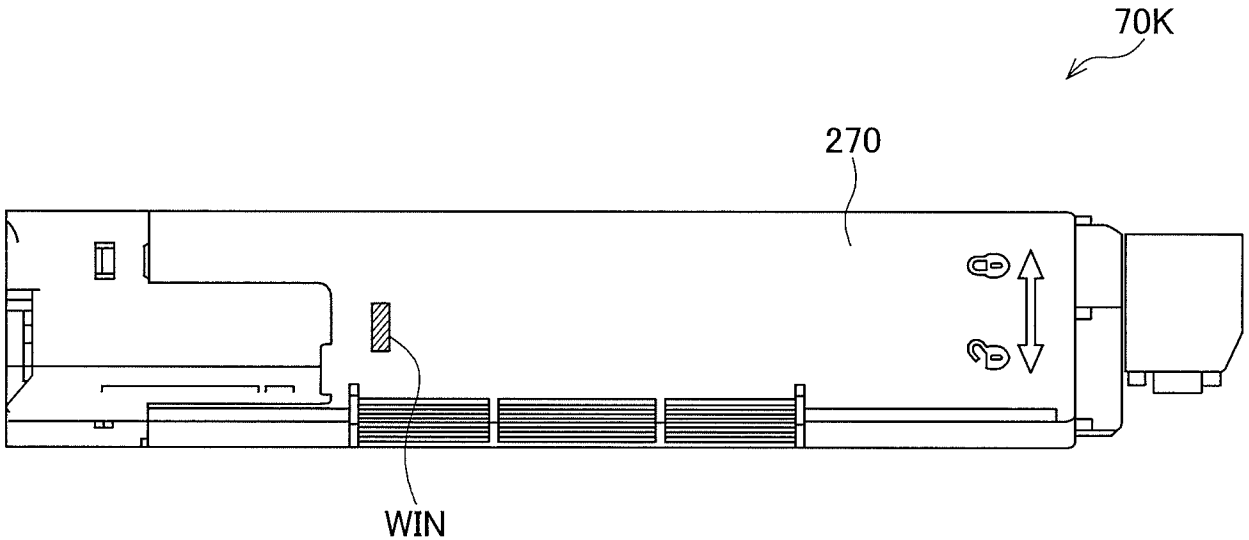
FIG. 16 is another view illustrating the exemplary configuration of the image forming unit in FIG. 15.

FIG. 16 is a top view of the image forming unit 70K. An indication window WIN is provided on a top surface of the toner storage portion 270 mounted on the image forming unit 70K (or image forming portion 210). The indicator 79 can be viewed through the indication window WIN by a user.

Figure 17:
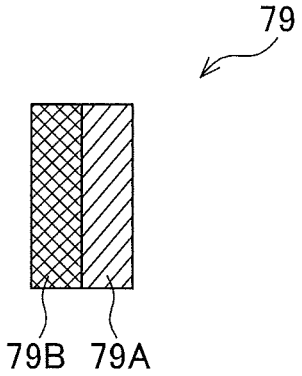
FIG. 17 is an explanatory drawing illustrating an exemplary configuration of an indicator in FIG. 15.

FIG. 17 illustrates an example of the indicator 79. In this example, the indicator 79 has two indicating portions 79A and 79B arranged in the left-right direction. The indicating portions 79A and 79B have different patterns thereon.

In this configuration, the movable wall 71 moves according to the amount of waste toner in the waste toner chamber 262. The indicator 79 moves according to the movement of the movable wall 71. Thereby, the part of the indicator 79 viewed by a user in the indication window WIN changes between the indicating portions 79A and 79B. As such, the indicator 79 indicates the amount of waste toner in the waste toner chamber 262.

The toner storage portion 270 serves as a developer container. The rotating member 275 serves as a first rotating member. The clutch 78 serves as a transmitting portion.

(Operation of Movable Wall, Clutch, and Indicator)

Figure 18A:
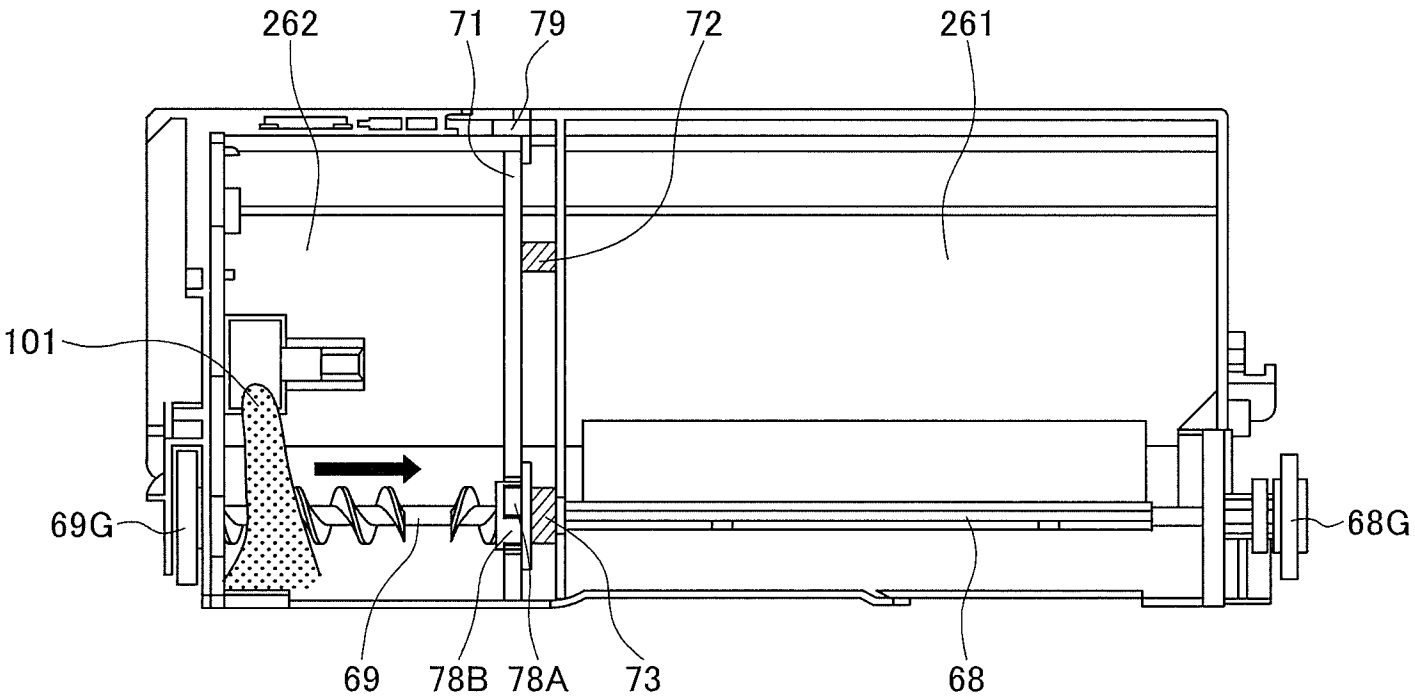
FIGS. 18A and 18B are drawings for explaining an exemplary operation of the image forming unit in FIG. 15.
Figure 18B:
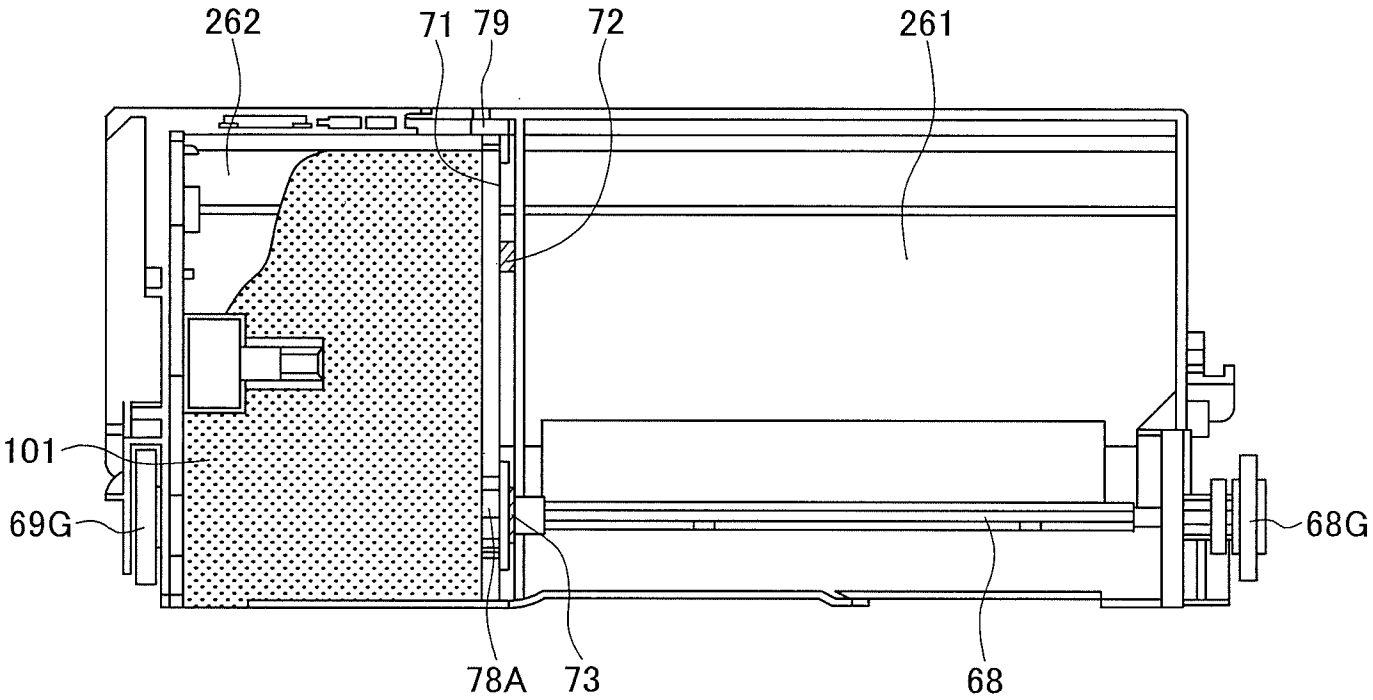
Figure 19A:
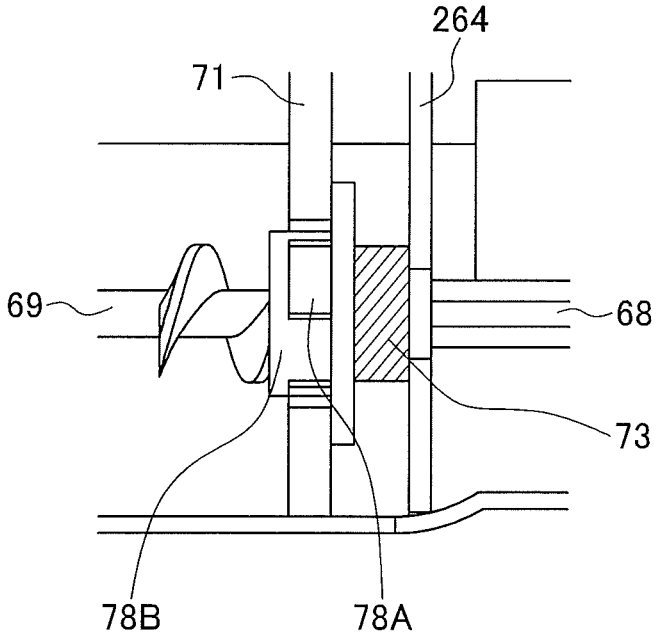
FIGS. 19A and 19B are drawings for explaining an exemplary operation of a clutch in FIG. 15.
Figure 19B:
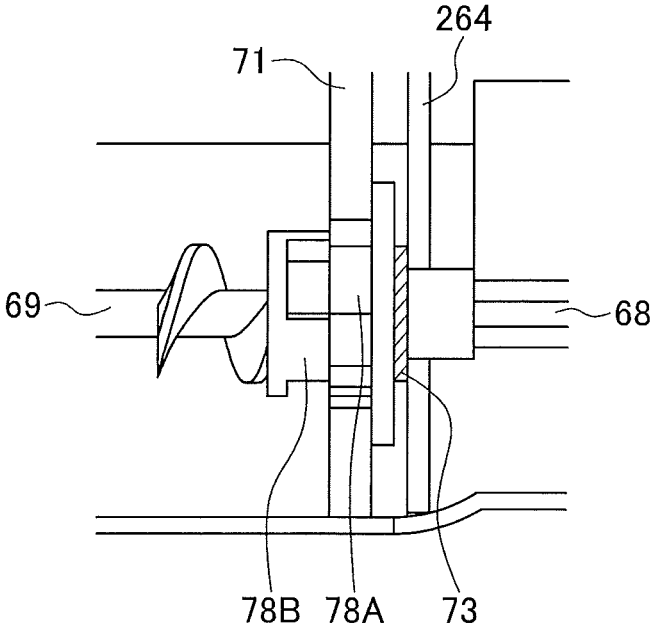
Figure 20A:
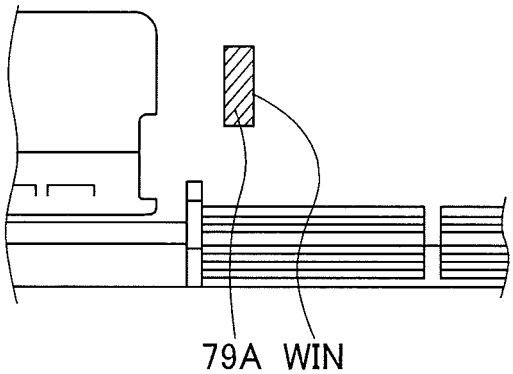

FIGS. 18A and 18B illustrate an exemplary operation of the movable wall 71; FIGS. 19A and 19B illustrate an exemplary operation of the clutch 78; FIGS. 20A and 20B illustrate an exemplary operation of the indicator 79. FIGS. 18A, 19A, and 20A illustrate a case where the amount of waste toner 101 in the waste toner chamber 262 is small; FIGS. 18B, 19B, and 20B illustrate a case where the amount of waste toner 101 in the waste toner chamber 262 is large.

When the amount of waste toner 101 in the waste toner chamber 262 is small, as illustrated in FIG. 18A, the first member 78A and second member 78B of the clutch 78 are engaged with each other, as illustrated in FIG. 19A. Thus, the driving force is transmitted from the agitating bar 68 to the conveying spiral 69. As illustrated in FIG. 18A, the waste toner 101 conveyed by the toner conveying member 23 to the waste toner chamber 262 is conveyed in the waste toner chamber 262 by rotation of the conveying spiral 69. Thereby, the waste toner 101 is stored uniformly in the waste toner chamber 262. At this time, the indicating portion 79A appears in the indication window WIN, as illustrated in FIG. 20A.

As the amount of waste toner 101 in the waste toner chamber 262 increases, the space occupied by the waste toner 101 in the waste toner chamber 262 increases, as illustrated in FIG. 18B. When the volume of the space occupied by the waste toner 101 reaches, for example, about 90 percent of the volume of the waste toner chamber 262, the force with which the waste toner 101 presses the movable wall 71 exceeds the force with which the springs 93 and 94 support the movable wall 71, so that the movable wall 71 moves. This movement of the movable wall 71 moves the indicator 79, so that the indicating portion 79B appears in the indication window WIN, as illustrated in FIG. 20B.

At this time, the first member 78A of the clutch 78 also moves with the movement of the movable wall 71. This disengages the first member 78A of the clutch 78 from the second member 78B of the clutch 78, as illustrated in FIG. 19B. Thus, the clutch 78 interrupts the transmission of the driving force from the agitating bar 68 to the conveying spiral 69.

(Detection Operation)

Next, an exemplary operation of the remaining amount detection bar 40, detector 50K, and detection controller 58K will be described.

Figure 21A:
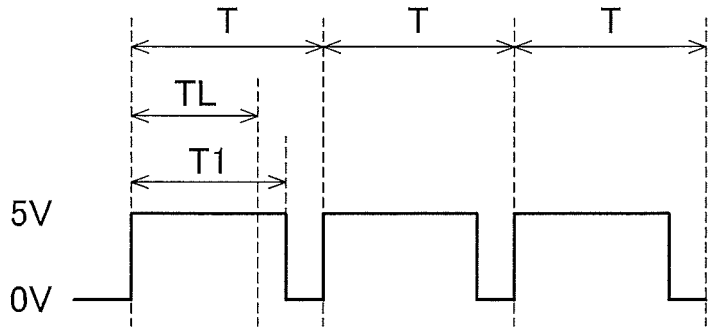
FIGS. 21A to 21F are waveform diagrams of signals generated by a detection unit in the third embodiment.
Figure 21B:
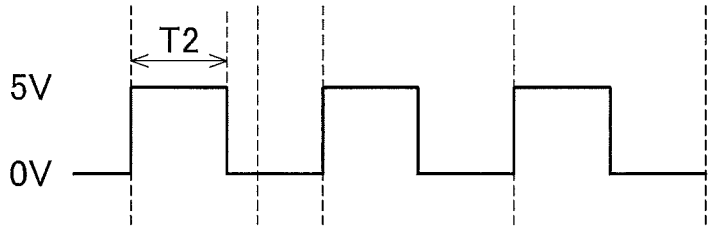
Figure 21C:
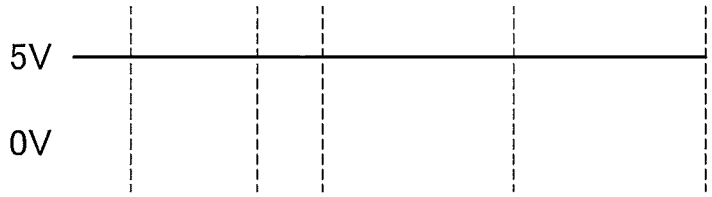
Figure 21D:
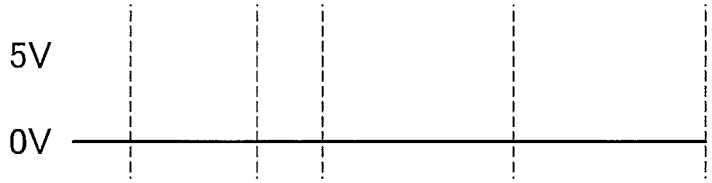
Figure 21E:
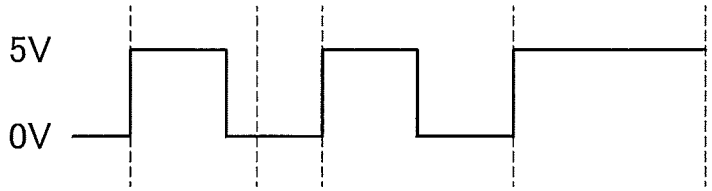
Figure 21F:
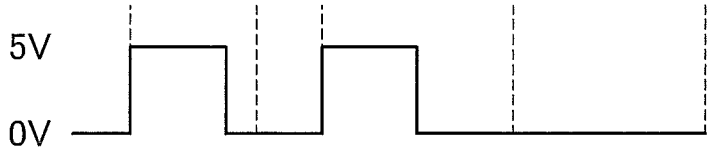

FIGS. 21A to 21F illustrate examples of the signal DET; FIG. 21A illustrates a case C1 where the remaining amount of toner is small; FIG. 21B illustrates a case C2 where the remaining amount of toner is large; FIGS. 21C and 21D illustrate cases where the toner storage portion 220 is absent; FIGS. 21E and 21F illustrate cases where the amount of waste toner 101 in the waste toner chamber 262 has become large. The operations in the cases C1 to C4 are substantially the same as those in the first embodiment (FIGS. 10A to 10D).

When the amount of waste toner 101 in the waste toner chamber 262 is small, the signal DET as illustrated in FIG. 21A or 21B is obtained depending on the amount of toner 100. When the amount of waste toner 101 in the waste toner chamber 262 has increased and the movable wall 71 has moved, the clutch 78 interrupts the transmission of the driving force from the agitating bar 68 to the conveying spiral 69, as described above. Thereby, the driving force is not transmitted to the remaining amount detection bar 40, so that the remaining amount detection bar 40 does not rotate and the reflecting plate 44 stays in the same position. Thus, after the clutch 78 interrupts the transmission of the driving force, the light receiving element 57K of the detection unit 55 constantly detects the reflected light LB from the reflecting plate 44 (FIG. 21E) or detects no reflected light LB (FIG. 21F).

The detection controller 58K detects that the amount of waste toner 101 in the waste toner chamber 262 is large, based on the signal DET illustrated in FIG. 21E or 21F. For example, if the state in which the reflected light LB is constantly received (the state of FIG. 21E) or the state in which no reflected light LB is received (the state of FIG. 21F) continues over, for example, two periods (2T) after the signal DET has changed from 0 V to 5 V or from 5 V to 0 V, the detection controller 58K determines that the amount of waste toner 101 in the waste toner chamber 262 is large. Then, the detection controller 58K notifies the controller 59 of the detection result. The controller 59 notifies a user that the amount of waste toner 101 in the waste toner chamber 262 is large (a waste toner full error) and controls the blocks of the image forming apparatus 3 to stop print operation.

As above, the image forming apparatus 3 is configured so that the clutch 78 interrupts the transmission of the driving force from the agitating bar 68 to the conveying spiral 69 in accordance with the movement of the movable wall 71. This makes it possible to detect the amount of waste toner 101 in the waste toner chamber 262 by using the mechanism for detecting the remaining amount of toner. Thus, the configuration of the image forming unit 70K can be simplified as compared to a case where a special mechanism for detecting the amount of waste toner 101 is introduced. As a result, for example, it is possible to downsize the image forming unit 70K and reduce the cost.

Modification

In the above embodiment, the remaining amount detection bar 40 is disposed in the image forming portion 210 of the image forming unit 70K, but this is not mandatory. For example, like the above modification of the first embodiment, the remaining amount detection bar 40 may be disposed in the toner chamber 261 of the toner storage portion 270.

Advantages

This embodiment discloses an image forming apparatus including: a developer container (the toner storage portion 270) including a first storage chamber (the toner chamber 261) for storing a first developer (the toner) and a transmitting unit (the agitating bar gear 68G, agitating bar 68, conveying spiral 69, and conveying spiral gear 69G) for transmitting driving force; a body (the main body 1*a* and image forming portion 210) to which the developer container is detachably mounted; a rotating member (the remaining amount detection bar 40) disposed in one of the developer container and the body and configured to rotate by receiving the driving force transmitted by the transmitting unit; and a detection unit (the detection unit 55) disposed in the body, the detection unit being configured to detect rotation of the rotating member and determine whether the developer container is mounted to the body, based on a result of the detection. The developer container further includes a second storage chamber (the waste toner chamber 262) for storing a second developer (the waste toner); the transmitting unit includes an interrupting member (the clutch 78) configured to interrupt the transmission of the driving force when the amount of the second developer stored in the second storage chamber reaches a predetermined amount; and the detection unit is configured to further determine the amount of the second developer in the second storage chamber based on a result of the detection. With this configuration, it is possible to detect whether the developer container is mounted to the body and the amount of the second developer in the second storage chamber, by means of the common rotating member. In one aspect, the interrupting member includes a first member (the first member 78A) and a second member (the second member 78B); the first member is configured to transmit the driving force to the second member by engaging with the second member; the second member is configured to transmit the driving force from the first member to the rotating member; and at least one of the first member and the second member is configured to be moved by pressure of the second developer in the second storage chamber to disengage the first member and the second member, thereby interrupting the transmission of the driving force.

The present invention is not limited to the embodiments and modifications described above, and various modifications can be made.

For example, in the above embodiments and modifications, the toner storage portion has the waste toner chamber. However, this is not mandatory and the toner storage portion has no waste toner chamber.

Further, for example, in the above embodiments and modifications, the toner chamber and waste toner chamber are formed in a single part. However, this is not mandatory and the toner chamber and waste toner chamber may be formed in two separable parts.

Further, for example, in the above embodiments and modifications, the present invention is applied to a color printer. However, this is not mandatory and the present invention is applicable to, for example, a monochrome printer.

Further, for example, in the above embodiments and modifications, the present invention is applied to a printer. However, this is not mandatory and the present invention is applicable to, for example, a multi-function peripheral having functions of a printer, a facsimile machine, a scanner, or the like.

What is claimed is:

1. A developer container comprising:

a housing having at least one storage chamber for storing developer;

a first rotating member extending from a first end portion to a second end portion through at least one of the at least one storage chamber;

a first gear connected to the first end portion and disposed outside of the housing; and a second gear connected to the second end portion and disposed outside of the housing, the first rotating member being configured to transmit driving force from the first gear to the second gear.

2. The developer container of claim 1, wherein the first rotating member includes a rotating body extending from the first end portion to the second end portion through the at least one of the at least one storage chamber.

3. The developer container of claim 1, wherein:

the at least one storage chamber comprises a first storage chamber for storing a first developer, and a second storage chamber for storing a second developer; and the first rotating member includes a first rotating body disposed in the first storage chamber and a second rotating body disposed in the second storage chamber.

4. The developer container of claim 3, wherein:

one of the first gear and the second gear is connected to one end portion of the first rotating body; and the other of the first gear and the second gear is connected to one end portion of the second rotating body.

5. The developer container of claim 3, wherein the first rotating member includes a transmitting portion disposed between the first rotating body and the second rotating body, and configured to transmit driving force between the first rotating body and the second rotating body.

6. The developer container of claim 5, wherein the transmitting portion is configured to be capable of interrupting the transmission of the driving force.

7. The developer container of claim 6, wherein the transmitting portion is configured to interrupt the transmission of the driving force when the amount of the second developer stored in the second storage chamber reaches a predetermined amount.

8. The developer container of claim 3, wherein the first rotating body is an agitating member for agitating the first developer stored in the first storage chamber.

9. The developer container of claim 3, wherein the second rotating body is a conveying member for conveying the second developer stored in the second storage chamber.

10. An image forming apparatus comprising the developer container of claim 1.

11. An image forming unit comprising:

the developer container of claim 1;

a housing having a developing chamber to which the developer stored in one of the at least one storage chamber is supplied;

a first driving force transmitting portion configured to transmit driving force to the first gear;

a second driving force transmitting portion configured to receive the driving force from the first gear through the first rotating member and the second gear and transmit the driving force; and a second rotating member disposed in the developing chamber and configured to rotate by receiving the driving force transmitted from the second driving force transmitting portion.

12. The image forming unit of claim 11, wherein the second rotating member includes:

a rotating body extending from a first end portion of the rotating body to a second end portion of the rotating body through the developing chamber;

a third gear connected to the first end portion of the rotating body and configured to receive the driving force transmitted from the second driving force transmitting portion; and a plate portion connected to the second end portion of the rotating body.

13. An image forming apparatus comprising the image forming unit of claim 12.

14. The image forming apparatus of claim 13, further comprising a detector configured to face the plate portion and detect a position of the plate portion.

15. The image forming apparatus of claim 14, further comprising a developer detector configured to detect the amount of the developer in the developing chamber based on a result of the detection by the detector.

16. An image forming apparatus comprising:

a developer container including a first storage chamber for storing a first developer and a transmitting unit for transmitting driving force;

a body to which the developer container is detachably mounted;

a rotating member disposed in one of the developer container and the body and configured to rotate by receiving the driving force transmitted by the transmitting unit; and a detection unit disposed in the body, the detection unit being configured to detect rotation of the rotating member and determine whether the developer container is mounted to the body, based on a result of the detection.

17. The image forming apparatus of claim 16, wherein:

the body includes a developing chamber to which the first developer stored in the first storage chamber is supplied, and an image forming member for forming an image using the first developer stored in the developing chamber;

the rotating member is disposed in the developing chamber; and the detection unit is configured to further determine the amount of the first developer in the developing chamber based on a result of the detection.

18. The image forming apparatus of claim 16, wherein:

the rotating member is disposed in the first storage chamber; and the detection unit is configured to further determine the amount of the first developer in the first storage chamber based on a result of the detection.

19. The image forming apparatus of claim 16, wherein:

the developer container further includes a second storage chamber for storing a second developer;

the transmitting unit includes an interrupting member configured to interrupt the transmission of the driving force when the amount of the second developer stored in the second storage chamber reaches a predetermined amount; and the detection unit is configured to further determine the amount of the second developer in the second storage chamber based on a result of the detection.

20. The image forming apparatus of claim 19, wherein:

the interrupting member includes a first member and a second member;

the first member is configured to transmit the driving force to the second member by engaging with the second member;

the second member is configured to transmit the driving force from the first member to the rotating member; and at least one of the first member and the second member is configured to be moved by pressure of the second developer in the second storage chamber to disengage the first member and the second member, thereby interrupting the transmission of the driving force.

* * * * *